United States Patent [19]

Miyasaki et al.

[11] Patent Number: 4,769,316

[45] Date of Patent: Sep. 6, 1988

[54] METHOD FOR RESTRAINING THE FORMATION OF RE-REVERSAL NEGATIVE IMAGE IN DIRECT POSITIVE SILVER HALIDE PHOTOGRAPHIC MATERIALS

[75] Inventors: Tsutomu Miyasaki; Shigeo Hirano; Kiyoshi Morimoto, all of Kanagawa, Japan

[73] Assignee: Fuji Photo Film Co., Ltd., Kanagawa, Japan

[21] Appl. No.: 876,300

[22] Filed: Jun. 18, 1986

Related U.S. Application Data

[63] Continuation-in-part of Ser. No. 656,791, Oct. 1, 1984, abandoned.

[30] Foreign Application Priority Data

Sep. 30, 1983 [JP] Japan ..... 58-182817

[51] Int. Cl.[4] ..... G03C 1/12; G03C 1/06

[52] U.S. Cl. ..... 430/570; 430/591; 430/592; 430/585; 430/589; 430/583; 430/584; 430/593; 430/614; 430/940; 430/598; 430/410

[58] Field of Search ..... 430/598, 570, 591, 592, 430/585, 589, 583, 584, 614, 940, 593, 410

[56] References Cited

U.S. PATENT DOCUMENTS

| | | | |
|---|---|---|---|
| 3,772,030 | 11/1973 | Gilman et al. | 430/589 |
| 4,306,016 | 12/1981 | Baralle et al. | 430/589 |
| 4,324,855 | 4/1982 | Oishi et al. | 430/598 |
| 4,395,478 | 7/1983 | Hoyen | 430/598 |
| 4,440,851 | 4/1984 | Tosaka et al. | 430/940 |
| 4,481,285 | 11/1984 | Takagi et al. | 430/598 |

FOREIGN PATENT DOCUMENTS

| | | | |
|---|---|---|---|
| 57-79940 | 5/1982 | Japan | 430/940 |
| 57-125937 | 8/1982 | Japan | 430/940 |
| 57-129438 | 8/1982 | Japan | 430/940 |
| 2110419 | 6/1983 | United Kingdom | 430/940 |

*Primary Examiner*—Won H. Louie

*Attorney, Agent, or Firm*—Sughrue, Mion, Zinn, Macpeak & Seas

[57] ABSTRACT

A restraining method for restraining the formation of a re-reversal negative image is described, comprising incorporating a cyanine dye or a merocyanine dye which is electron donative and is adsorbable on silver halide in at least one hydrophilic colloid layer of an internal latent image type direct positive silver halide photographic material as a re-reversal restrainer.

35 Claims, 1 Drawing Sheet

METHOD FOR RESTRAINING THE FORMATION OF RE-REVERSAL NEGATIVE IMAGE IN DIRECT POSITIVE SILVER HALIDE PHOTOGRAPHIC MATERIALS

CROSS REFERENCE TO RELATED APPLICATION

This application is a continuation-in-part application of our co-pending U.S. application Ser. No. 06/656/791, filed Oct. 1, 1984, now abandoned.

FIELD OF THE INVENTION

This invention relates to a method for improving the image quality of direct positive silver halide photographic materials, and more particularly to a method for restraining the formation of re-reversal negative images, which becomes severe under high illuminance exposure in a direct positive silver halide photographic material. Furthermore, the invention also relates to a direct positive silver halide photographic material in which the formation of such re-reversal negative images is effectively restrained.

BACKGROUND OF THE INVENTION

In the field of a silver halide photographic processes a photographic process for obtaining a positive photographic image by a single step after step after image exposure without need of reversal processing for obtaining positive images is called a direct positive photographic process, and the photographic material for use in such a photographic process is called a direct positive photographic material. Typical examples of the direct positive photographic processes are: a process for developing silver halide grains after imagewise exposing the silver halide grains in the presence of a desensitizer; and a process involving surface-developing a silver halide emulsion having light-sensitive nuclei mainly in the inside of the silver halide grains in the presence of a nucleating agent or under an overall uniform exposure (fogging by light exposure) after imagewise exposure. The present invention particularly relates to the latter process.

That is, a silver halide emulsion having light-sensitive nuclei in the inside of the silver halide grains, and hence forming a latent image mainly in the inside of the silver halide grains, is called an internal latent image-type silver halide emulsion, and is fundamentally different from an ordinary silver halide emulsion mainly forming a latent image on the surfaces of the silver halide grains.

In the internal latent image-type silver halide emulsion, the silver halide grains are not substantially surface-nucleating developed, since the latent image formed on the light-sensitive nuclei in the inside of the silver halide grains capture electrons from the nucleating agent. On the other hand, since the unexposed silver halide grains do not have an internal latent image, a latent image (fogged nuclei) is formed on the surface of the silver halide grains by the provision of electrons from the nucleating agent, whereby the unexposed silver halide grains can be surface-developed. Thus, by the surface nucleating development after exposure, a positive image is formed in one step.

In order for the aforesaid process for obtaining a direct positive image by a surface nucleating development to be practically used, improvements in the fundamental photographic characteristics, such as the improvement of photographic sensitivity, increase of the maximum density ($D_{max}$), reduction of the minimum density ($D_{min}$), etc., are, as a matter of course, required, and for such purposes, many patents and patent publications (including unexamined publications) as described hereinafter have been provided for the improvement of such photographic materials, such as with respect to grains of the silver halide emulsions, sensitizers, nucleating agents, etc. However, the formation of a re-reversal negative image which is a significant defect in a practical internal latent image-type directive positive silver halide emulsion, has not yet been prevented in spite of the fact that the formation of the re-reversal negative image is a significant problem reducing image quality. The formation of the re-reversal negative image specific to the internal latent image-type silver halide emulsion is remarkable when the photographic material is exposed under high illuminance, and in particular when the photographic material is exposed to sunlight or an electronic flash of a camera and causes development on the photographic material as dark black spots. Thus, a positive counterplan for preventing the formation of such a re-reversal negative image under high illuminance and for improving image quality has been strongly desired.

SUMMARY OF THE INVENTION

One object of this invention is to provide a method of preventing the formation of the aforesaid high illuminance re-reversal negative image.

Another object of this invention is to provide a direct positive silver halide photographic material having improved photographic properties by controlling the formation of the re-reversal negative image.

A further particular object of this invention is to provide a direct positive silver halide photographic material capable of giving improved direct positive images by restraining the formation of the re-reversal negative images (by desensitizing with respect to the re-reversal negative images) as well as providing good maximum density and minimum density and fast developing progress in a photographic process for obtaining a direct positive image by subjecting an internal latent image-type silver halide photographic emulsion to a surface development in the presence of a nucleating agent.

According to this invention, then, a method is provided for restraining the formation of a re-reversal negative image, which tends to be a problem under high illuminance exposure (usually, more than 100 lux), comprising incorporating a cyanine dye or merocyanine dye which is electron donative and adsorbable on silver halide grains in at least one hydrophilic colloid layer of an internal latent image-type direct positive silver halide photographic material as a re-reversal restrainer.

According to another embodiment of this invention, an internal latent image-type direct positive silver halide photographic material is provided containing the above-described cyanine dye or merocyanine dye in at least one hydrophilic colloid layer of the photographic material.

DESCRIPTION OF PREFERRED EMBODIMENTS

For attaining the above-described objects of this invention, the inventors first assumed a principle regarding the formation of a re-reversal negative image as described hereinafter and based on such assumption, the inventors found a reaction principle necessary for restraining negative image formation and the chemical properties which must be possessed by a negative image restrainer.

Figure 1:
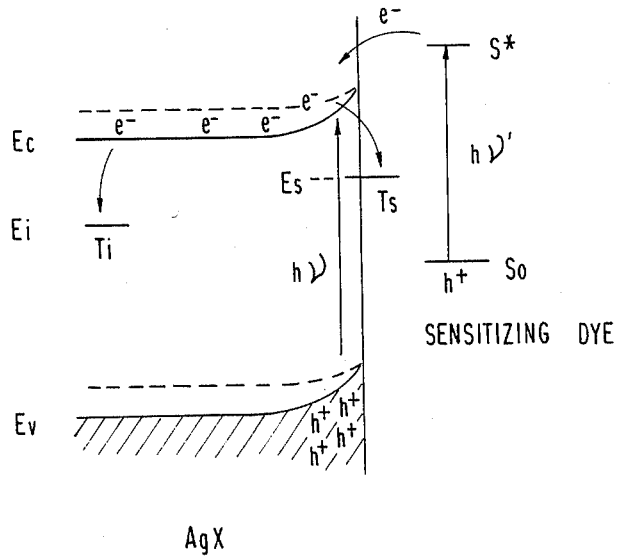
FIG. 1 is a schematic view for explaining a mechanism of the formation of a re-reversal negative image.

Principle of the formation of re-reversal negative image:

FIG. 1 is a schematic view illustrating the band structure of the surface of internal latent image-type silver halide crystals and the energy level of a sensitizing dye, wherein $E_c$ stands for a conduction band level, $E_v$ for a valence electron band level, $E_i$ for an electron trap (light-sensitive nucleus) level which becomes a nucleus for forming a latent image in the inside of silver halide crystal, $E_s$ for a level of an electron trap which becomes a nucleus for forming a negative image at the surface of silver halide crystal, and $S_o$ and $S^*$ stand for the donor level of the ground state and the donor level of the excited state, respectively, of the sensitizing dye. Also, in FIG. 1, $e^-$ and $h^+$ and indicate an excited electron and a positive hole, respectively, and $h\nu$ and $h\nu'$ stand for the energies of their excited states, respectively.

When a silver halide (AgX) is light-exposed, an electron at the surface of the silver halide is excited to the conduction band to form a positive hole in the valence electron band when the exposure is made in the intrinsic region, while the injection of an excited electron occurs from the adsorbed dye into a conduction band to form a positive hole of the dye on the surface of the silver halide when the exposure is in the spectral sensitization region (color sensitization region). The electron formed in the conduction band diffuses into the bulk in the silver halide crystal along the band bending of the band in a short time (generally shorter than $10^{-6}$ sec.), and after being caught by an electron trap ($T_i$) existing in the inside of the crystal, forms an internal latent image nucleus. This process is a process for forming an internal latent image which ordinarily occurs when the intensity of the light exposure is not so high, but in an ordinary range.

However, the circumstances change when silver halide is exposed under light of high intensity, and many excited electrons and positive holes are simultaneously formed in a short time. In this case, a large number of electrons are injected into the conduction band faster than the aforesaid diffusion of the excited electrons into the inside of the crystal, and the occurrence of traps at the light-sensitive nucleus, whereby instantaneous photoelectrons are accumulated in the conduction band to moderate the band bending (the state shown by the dotted line in FIG. 1), whereby the diffusion of the photoelectrons into the inside of the silver halide is restrained. Furthermore, the electric field generated by the positive holes largely formed on the surface of the silver halide has an influence of restraining the transfer of the photoelectrons into the inside of the silver halide crystal. In such a state, there is a high possibility that the photoelectrons will be deactivated by recombination with the positive holes near the surface of the silver halide during the life of the photoelectrons, or will be by proper traps ($T_s$) on the surface of the silver halide to form surface latent image nuclei. In the latter case, the surface latent image nuclei form a silver image by a surface development process, which results in forming a so-called re-reversal negative image on the surface of the silver halide by the high illuminance exposure as described above.

Principle of negative image formation restraint:

In the above-described process of forming the rereversal negative image, the main reason of formation of the surface negative latent image nuclei is considered to be the back diffusion of the photoelectrons into the surface of the silver halide by the existence of the positive holes of the bulk attracting the photoelectrons in the conductive band onto the surface of the silver halide and the moderation of band bending. One of the means for restraining the occurrence of these phenomena is to add a component capable of quickly electrically neutralizing the aforesaid positive holes and effectively capturing the photoelectrons which back diffuse into the surface of the silver halide to form surface latent image nuclei to the silver halide emulsion system.

Figure 2:
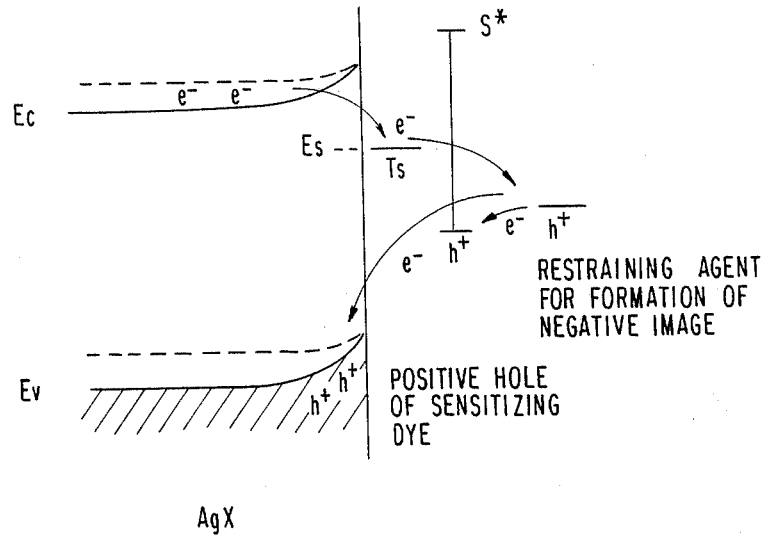
FIG. 2 is a schematic view for explaining a mechanism for restraining the formation of the negative image.

FIG. 2 is a schematic view showing the principle and mechanism for restraining the formation of the negative image by the compound as described above. The compound is an electron donor and first gives electrons to the positive holes of a silver halide or sensitizing dye formed by the light reaction. Then, the positive holes of the compound thus formed (the oxidized product radical) retrap the photoelectrons back-diffused into the surface of the silver halide and the photoelectrons already captured by the surface traps ($T_s$) to prevent the formation of surface latent image nuclei. For restraining the formation of the negative image according to the aforesaid mechanism, it is considered that the compound is required to satisfy the following requirements.

(1) The compound is electron donor and the oxidation potential of the compound is electrochemically more negative than the valence electron band level of silver halide and the positive hole level (i.e., oxidation potential) of a spectral sensitization dye in the emulsion.

(2) From the property capable of bleaching surface latent image nuclei, the oxidation potential (maximum occupied-level) of the compound is more positive than the level ($E_s$) of the surface trap.

(3) Since the positive holes of the compound must be comparatively stable, the compound has an electronic resonance structure.

(4) The compound has a property of being adsorbed on the surface of silver halide.

As a result of investigating compounds having the above-described properties, the inventors have found that a cyanine dye or a merocyanine dye which is electron donative and can be adsorbed on silver halide (such a dye has an electronic resonance structure) is very effective for attaining the purpose of restraining the formation of the negative image. The particularly remarkable negative image restraining effect is seen in the group of the above-described dyes having a comparatively more negative oxidation potential (from +0.3 to 0.9 volt, and more preferably from +0.4 to 0.8 volt with respect to a saturated calomel standard electrode) satisfying the above-described condition (1). The inventors have experimentally confirmed that by adding an appropriate amount (e.g., $1\times10^{-6}$ to $5\times10^{-3}$ mole per mole of silver halide) of the dye as described above to the hydrophilic colloid layer (preferably a silver halide emulsion layer) to an internal latent image-type direct positive silver halide photographic material, the formation of re-reversal negative images of the direct positive photographic material can be effectively restrained to improve the practical image quality, and thus have succeeded in obtaining this invention.

By the term "re-reversal restrainer" used in the specification of this application is meant a material which reduces the relative sensitivity of a re-reversal negative image in the case of adding the material into a direct positive silver halide photographic material in accordance with the above explanation.

The restraining method of the re-reversal negative image of this invention is particularly effectively applied to a direct positive silver halide photographic material.

That is, the method of this invention is effectively applied to an internal latent image-type direct positive silver halide photographic material comprising at least one internal latent image-type direct positive silver halide photographic emulsion layer providing maximum sensitivity of the high illuminance re-reversal negative images of higher than 30, and preferably higher than 50 (prior to incorporating a re-reversal restrainer) by the sensitivity as defined below. Such an emulsion layer is obtained when the photographic sensitivity of the emulsion is highly increased by a sensitizing method. A photographic material which provides a higher photographic sensitivity provides a higher maximum sensitivity of the high illuminance re-reversal negative images.

Coating Condition: The silver halide emulsion containing no re-reversal restrainer is uniformly coated on one surface of a transparent support in one layer at a silver coverage of 5.0 g/m$^2$ to provide a black and white internal latent image-type direct positive photographic material, with the nucleating agent shown below is added to the silver halide emulsion and the addition amount thereof is adjusted so that the maximum density of the direct positive image obtained after development becomes higher than 1.0.

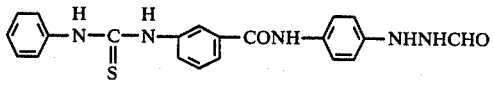

Exposure Condition: The silver halide emulsion layer side of the photographic material is exposed for 1/10,000 second to white light having a color temperature of 4,800° K. using a xenon lamp as a light source.

Processing Condition: After developing the photographic material using a surface developer composed of 0.06% by weight 1-phenyl-3-pyrazolidone, 1% by weight hydroquinone, 3% by weight sodium sulfite, 4% by weight sodium tertiary phosphate and 1.1% by weight sodium hydroxide at 20° C. for 10 minutes, and then fixed and washed.

Negative Sensitivity Indication: Indicated by 100 times the reciprocal of the exposure amount [cd. m. s. (candle, meter, second)] in the density point of (maximum density+minimum density)×½ of the negative image.

It is preferred that the direct positive silver halide photographic material to which the method of this invention is applied has at least one silver halide emulsion layer on a support and said silver halide emulsion layer contains at least one kind of silver halide grain group having a mean side length longer than 0.7 μm measured by a projected area method.

Also, it is preferred that the direct positive silver halide photographic material has at least one direct positive silver halide emulsion layer spectrally sensitized by a spectral sensitizing dye on a support, and that the oxidation potential of the re-reversal restrainer for use in this invention be electrochemically more negative than the oxidation potential of the above-described spectral sensitizing dye. When the restrainer has spectrally sensitizing ability, especially in the blue region, the spectral absorption characteristic thereof is preferably the same or nearly same as that of the co-existing sensitizing dye.

There is no particular restriction on the direct positive silver halide photographic emulsion materials to which the method of this invention is applied, and the photographic materials may be black and white photographic materials or color photographic materials. The color photographic materials may be so-called conventional color photographic material using couplers, photographic materials for a color diffusion transfer process, or photographic materials (containing an internal latent image type direct positive silver halide emulsion) for heat-sensitive recording, e.g., as described in EP 76492 A2.

The restraining method of re-reversal negative image of this invention is explained below in further detail.

The cyanine dyes or merocyanine dyes which are used in this invention are selected from monomethinecyanines, trimethinecyanines, pentamethinecyanines, apomerocyanines, dimethinemerocyanines, tetramethinemerocyanines, and trinuclear merocyanines, etc., and preferred embodiments are selected from the cyanine dyes and merocyanine dyes shown by the following formulae (I) to (IX). The cyanine dyes and merocyanine dyes may be used singly, as a combination of the cyanine dyes or merocyanine dyes, or further as a combination of cyanine dye and merocyanine dye.

Formula (I) is represented by

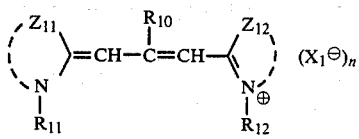

(I)

wherein $Z_{11}$ and $Z_{12}$ each represents a nonmetallic atomic group completing a thiazole nucleus, a thiazoline nucleus, benzothiazole nucleus, a naphthothiazole nucleus, benzoselenazole nucleus, or a naphthoselenazole nucleus; $R_{11}$ and $R_{12}$ each represents an alkyl group; $R_{10}$ represents a hydrogen atom, an alkyl group, or an aryl group; $X_1\ominus$ represents an acid anion; and n represents 0 or 1.

The terminology "alkyl group" (including alkyl residue) or "aryl group" (including aryl residue) is used inclusive of substituted alkyl and aryl groups.

Formula (II) is represented by

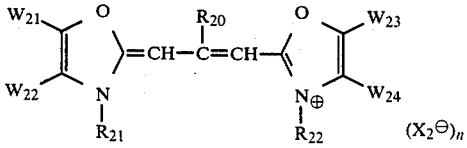

(II)

wherein $W_{21}$, $W_{22}$, $W_{23}$, and $W_{24}$ each represents a hydrogen atom, an alkyl group, or an aryl group; said $W_{21}$ and $W_{22}$ or said $W_{23}$ and $W_{24}$ may combine with each other to form a benzene ring or a naphthalene ring, or each of the groups may have a substituent; $R_{21}$ and $R_{22}$ each represents an alkyl group; $R_{20}$ represents a hydrogen atom, an alkyl group or an aryl group; $X_2^{\ominus}$ represents an acid anion; and n represents 0 or 1.

Formula (III) is represented by

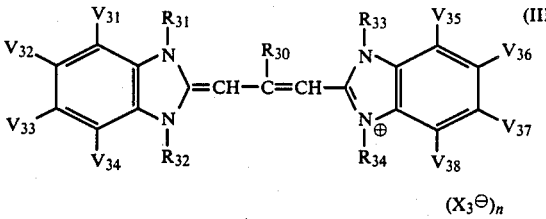

(III)

wherein $V_{31}$ to $V_{38}$ each represents a hydrogen atom, a halogen atom, a trifluoromethyl group, a cyano group, a carboxy group, an alkoxycarbonyl group, a sulfamoyl group, a sulfonyl group, or a carbamoyl group; said $V_{31}$ and $V_{32}$, said $V_{32}$ and $V_{33}$, said $V_{33}$ and $V_{34}$, said $V_{35}$ and $V_{36}$, said $V_{36}$ and $V_{37}$ or said $V_{37}$ and $V_{38}$ may combine with each other to form a carbon ring (e.g., a benzene ring which may have a substituent); $R_{31}$ to $R_{34}$ each represents an alkyl group; $R_{30}$ represents a hydrogen atom, an alkyl group or an aryl group; $X_3^{\ominus}$ represents an acid anion; and n represents 0 or 1.

Formula (IV) is represented by

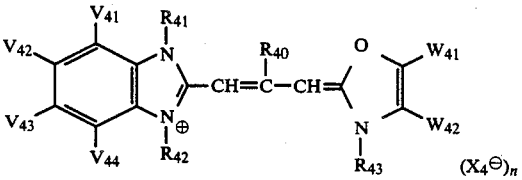

(IV)

wherein $V_{41}$ to $V_{44}$, $R_{41}$ and $R_{42}$ have the same meanings as $V_{31}$ to $V_{34}$, $R_{31}$ and $R_{32}$, respectively, defined for formula (III); $W_{41}$, $W_{42}$, and $R_{43}$ have the same meanings as $W_{21}$, $W_{22}$, and $R_{21}$, respectively, in formula (II); $R_{40}$ represents a hydrogen atom, an alkyl group, or an aryl group; $X_4^{\ominus}$ represents an acid anion; and n represents 0 or 1.

Formula (V) is represented by

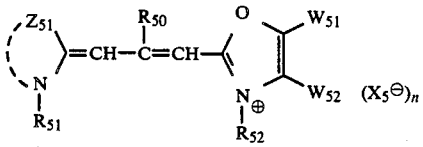

(V)

wherein $Z_{51}$, $R_{50}$, and $R_{51}$ have the same meanings as $Z_{11}$, $R_{10}$ and $R_{11}$, respectively, in formula (I); $W_{51}$, $W_{52}$, and $R_{52}$ have the same meanings as $W_{21}$, $W_{22}$, and $R_{21}$, respectively, in formula (II); $X_5^{\ominus}$ represents an acid anion; and n represents 0 or 1.

Formula (VI) is represented by

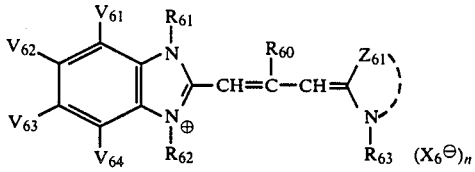

(VI)

wherein $V_{61}$ to $V_{64}$, $R_{61}$ and $R_{62}$ have the same meanings as $V_{31}$ to $V_{34}$, $R_{31}$ and $R_{32}$ respectively in formula (III), $Z_{61}$, $R_{63}$, and $R_{60}$ have the same meanings as $Z_{11}$, $R_{12}$, and $R_{10}$, respectively, in formula (I); said $Z_{61}$ further includes a non-metallic atomic group completing an indoline nucleus; $X_6^{\ominus}$ represents an acid anion; and n represents 0 or 1.

Formula (VII) is represented by

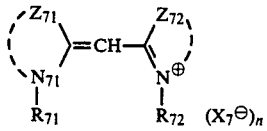

(VII)

wherein $Z_{71}$ and $Z_{72}$ each represents a non-metallic atomic group forming a benzoxazole nucleus, a benzothiazole nucleus, a benzoselenazole nucleus, a naphthoxazole nucleus, a naphthothiazole nucleus, a naphthoselenazole nucleus, a thiazole nucleus, a thiazoline nucleus, an oxazole nucleus, a selenazole nucleus, a selenazoline nucleus, a pyridine nucleus, or a quinoline nucleus; $R_{71}$ and $R_{72}$ each represents an alkyl group; $X_7^{\ominus}$ represents an acid anion; and n represents 0 or 1.

Formula (VIII) is represented by

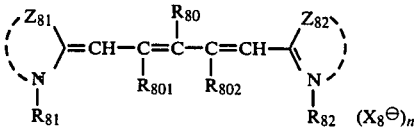

(VIII)

wherein $Z_{81}$ and $Z_{82}$ each represents a nonmetallic atomic group completing a pyridine nucleus, a quinoline nucleus, a benzothiazole nucleus, a naphthothiazole nucleus, a benzoxazole nucleus, a benzoselenazole nucleus, a naphthoxazole nucleus, a naphthoselenazole nucleus, a thiazole nucleus, or a thiazoline nucleus; $R_{81}$ and $R_{82}$ each represents an alkyl group; $R_{80}$, $R_{801}$ and $R_{802}$ each represents a hydrogen atom, an alkyl group, or a halogen atom; said $R_{801}$ and $R_{802}$ may combine with each other to form a ring; $X_8^{\ominus}$ represents an acid anion; and n represents 0 or 1.

Formula (IX) is represented by

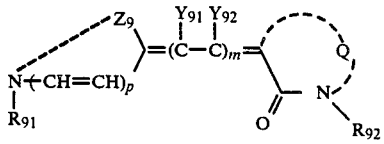

(IX)

wherein $Z_9$ represents a nonmetallic atomic group completing a thiazoline nucleus, a thiazolidine nucleus, a selenazoline nucleus, a selenazolidine nucleus, a pyrrolidine nucleus, a dihydropyridine nucleus, an oxazoline nucleus, an oxazolidine nucleus, an imidazoline nucleus, an indoline nucleus, a tetrazoline nucleus, a benzothiazoline nucleus, a benzoselenazoline nucleus, a benzimidazoline nucleus, a benzoxazoline nucleus, a naphthothiazoline nucleus, a naphthoselenazoline nucleus, a naphthoxazoline nucleus, a naphthoimidazoline nucleus, or a dihydroquinoline nucleus; Q represents a nonmetallic atomic group necessary for completing a rhodanine nucleus, a 2-thiooxazoline-2,4-dione nucleus, a 2-thioselenazoline-2,4-dione nucleus, a 2-thiohydantoin nucleus, a barbituric acid nucleus or 2-thiobarbituric acid nucleus; $R_{91}$ and $R_{92}$ each represents a hydrogen atom, an alkyl group, or an aryl group; $Y_{91}$ and $Y_{92}$ each represents a hydrogen atom, an alkyl group, or an aryl group; m represents 0, 1 or 2; and p represents 0 or 1.

The alkyl groups represented by $R_{11}$, $R_{12}$, $R_{21}$, $R_{22}$, $R_{31}$, $R_{32}$, $R_{33}$, $R_{34}$, $R_{41}$, $R_{42}$, $R_{43}$, $R_{51}$, $R_{52}$, $R_{61}$, $R_{62}$, $R_{63}$, $R_{71}$, $R_{72}$, $R_{81}$, and $R_{82}$ include unsubstituted and substituted alkyl groups, and examples of the unsubstituted alkyl group are preferably alkyl groups having less than 18 carbon atoms, and more preferably, less than 8 carbon atoms, such as a methyl group, an ethyl group, an n-propyl group, an n-butyl group, an n-hexyl group and an n-octadecyl group. Also, examples of the substituted alkyl group are preferably those having an alkyl moiety of less than 6 carbon atoms, and more preferably less than 4 carbon atoms; such as a sulfo group-substituted alkyl group, said sulfo group [in this invention the term "sulfo group" includes $—SO_3H$, $—SO_3\ominus$, sulfate group (e.g., $—SO_3Na$ and $—SO_3K$) and $—SO_3H.A$ (A: an amine)] may combine thereto through at least one alkoxy group or an aryl group (e.g., a 2-sulfoethyl group, a 3-sulfopropyl group, a 4-sulfobutyl group, a 2-(3-sulfopropoxy)ethyl group, a 2[2-(3-sulfopropoxy)ethoxy]ethyl group, a 2-hydroxy-3-sulfopropyl group, a p-sulfophenethyl group, a p-sulfophenylpropyl group, etc.); a carboxy group-substituted alkyl group, said carboxy group may combine thereto through at least one alkoxy group or an aryl group (e.g., a carboxymethyl group, a 2-carboxyethyl group, a 3-carboxypropyl group, a 4-carboxybutyl group, etc.); a hydroxyalkyl group (e.g., a 2-hydroxyethyl group, a 3-hydroxypropyl group, etc.); an acyloxyalkyl group (e.g., a 2-acetoxyethyl group, a 3-acetoxypropyl group, etc.); an alkoxyalkyl group (e.g., a 2-methoxyethyl group, a 3-methoxypropyl group, etc.); an alkoxycarbonylalkyl group (e.g., a 2-methoxycarbonylethyl group, a 3-methoxycarbonylpropyl group, a 4-ethoxycarbonylbutyl group, etc.); a vinyl group-substituted alkyl group (e.g., an allyl group, etc.); a cyanoalkyl group (e.g., a 2-cyanoethyl group, etc.); a carbamoylalkyl group (e.g., a 2-carbamoylethyl group, etc.); an aryloxyalkyl group (e.g., a 2-phenoxyethyl group, a 3-phenoxypropyl group, etc.); an aralkyl group (e.g., a 2-phenethyl group, a 3-phenylpropyl group, etc.); or an aryloxyalkyl group (e.g., a 2-phenoxyethyl group, a 3-phenoxypropyl group, etc.).

The alkyl group shown by $R_{10}$, $R_{20}$, $R_{30}$, $R_{40}$, $R_{50}$, $R_{60}$, $R_{80}$, $R_{801}$, and $R_{802}$ in the above-described general formula include unsubstituted and substituted alkyl groups. Examples of the unsubstituted alkyl group are preferably those having less than 4 carbon atoms, such as a methyl group, an ethyl group, a propyl group, etc. Also, examples of the substituted alkyl group are an aralkyl group (e.g., a benzyl group, a 2-phenethyl group, etc.). Also, examples of the aryl group are a phenyl group, etc.

Examples of the halogen atom shown by $R_{80}$, $R_{801}$, and $R_{802}$ are a chlorine atom, a fluorine atom, and a bromine atom. Also, examples of the ring formed by the combination of $R_{801}$ and $R_{802}$ are a 6-membered ring, etc. $R_{10}$, $R_{20}$, and $R_{50}$ are preferably an ethyl group, and $R_{30}$, $R_{40}$, and $R_{60}$ are preferably a hydrogen atom.

Examples of the acid anion shown by $X_1\ominus$ to $X_8\ominus$ are a chloride ion, a bromide ion, an iodide ion, a methyl sulfate ion, an ethyl sulfate ion, a p-toluene sulfonate ion, etc.

Also, n represents 0 or 1 and when the dye forms an intramolecular salt, n represents 0.

Also, $V_{31}$ to $V_{38}$, $V_{41}$ to $V_{44}$, and $V_{61}$ to $V_{64}$ each represents a hydrogen atom, a halogen atom (e.g., a fluorine atom, a chlorine atom, a bromine atom, an iodine atom, etc.), a trifluoromethyl group, a cyano group, a carboxy group, an alkoxycarbonyl group (e.g., a methoxycarbonyl group, an ethoxycarbonyl group, etc.), a sulfamoyl group such as a sulfamoyl group, a mono- or di-alkylsulfamoyl group (e.g., a methylsulfamoyl group, a dimethylsulfamoyl group, a diethylsulfamoyl group, etc.), a sulfonyl group such as an alkylsulfonyl group (e.g., a methylsulfonyl group, etc.), an arylsulfonyl group (e.g., a phenylsulfonyl group, etc.), etc., or a carbamoyl group such as an N-alkylcarbamoyl group (e.g., N-methylcarbamoyl group, etc.), an N-arylcarbamoyl group (e.g., an N-phenylcarbamoyl group, etc.), etc.

$V_{31}$, $V_{34}$, $V_{35}$, $V_{38}$, $V_{41}$, $V_{44}$, $V_{61}$ and $V_{64}$ are preferably a hydrogen atom. Also, particularly preferred examples of $V_{32}$, $V_{36}$, $V_{42}$ and $V_{62}$ are a chlorine atom, and particularly preferred examples of $V_{33}$, $V_{37}$, $V_{43}$, and $V_{63}$ are a chlorine atom, a trifluoromethyl group, or a cyano group.

$W_{21}$ to $W_{24}$, $W_{41}$ and $W_{42}$, and $W_{51}$ and $W_{52}$ each represents an unsubstituted alkyl group such as a methyl group, an ethyl group, etc.; a substituted alkyl group such as a benzyl group, an aryl group, etc.; or an aryl group such as a phenyl group, a natphthyl group, etc. Furthermore, examples of the benzoxazole wherein a benzene ring or a naphthalene ring is formed by the combination of said $W_{21}$ and $W_{22}$, said $W_{23}$ and $W_{24}$, said $W_{41}$ and $W_{42}$, or said $W_{51}$ and $W_{52}$ are as follows:

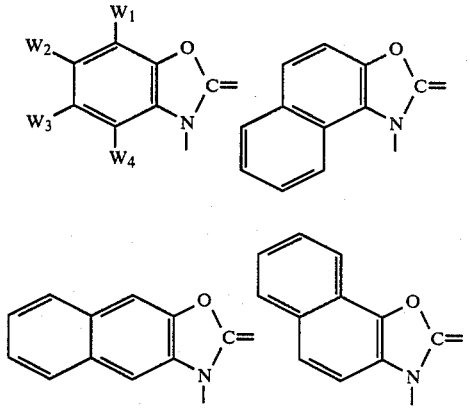

wherein, $W_1$, $W_2$, $W_3$ and $W_4$ each represents a hydrogen atom, a halogen atom (a fluorine atom, a chlorine atom, a bromine atom, and an iodine atom), an alkyl group (e.g., a methyl group, an ethyl group, etc.), an alkoxy group (e.g., a methoxy group, an ethoxy group, etc.), a hydroxy group, an acyloxy group (e.g., an acetoxy group, etc.), or an aryl group (e.g., a phenyl group, etc.). $W_1$ and $W_4$ are preferably a hydrogen atom. $W_2$ is preferably a hydrogen atom or a halogen atom, and more preferably a hydrogen atom. $W_3$ is preferably a halogen atom (particularly a chlorine atom), a phenyl group or an alkoxy group (particularly a methoxy group).

The compound shown by the above-described formula (III) includes a compound of the type wherein a proton is added to the compound of formula (III). It is considered that the proton is added to one of methine groups.

The heterocyclic ring formed by $Z_{11}$, $Z_{12}$, $Z_{51}$, $Z_{61}$, $Z_{71}$, $Z_{72}$, $Z_{81}$, or $Z_9$ of formula (I) to (IX) may have at least one substituent. Examples of the substituent are a halogen atom (e.g., fluorine, chlorine, bromine, iodine), a nitro group, an alkyl group (preferably having from 1 to 4 carbon atoms, such as a methyl group, an ethyl group, a trifluoromethyl group, a benzyl group, a phenethyl group, etc.), an aryl group (e.g., a phenyl group), an alkoxy group (preferably having from 1 to 4 carbon atoms, such as a methoxy group, an ethoxy group, a propoxy group, a butoxy group, etc.), a carboxy group, an alkoxycarbonyl group (preferably having from 2 to 5 carbon atoms, such as an ethoxycarbonyl group, etc.), a hydroxy group, a cyano group, etc.

In regard to $Z_{11}$, $Z_{12}$, $Z_{51}$, $Z_{61}$, $Z_{71}$, $Z_{72}$, $Z_{81}$ and $Z_{82}$, examples of the benzothiazole nucleus are benzothiazole, 4-chlorobenzothiazole, 5-chlorobenzothiazole, 6-chlorobenzothiazole, 7-chlorobenzothiazole, 5-nitrobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methxoxybenzothiazole, 5-ethoxybenzothiazole, 5-propoxybenzothiazole, 5-carboxybenzothiazole, 5-ethoxycarbonylbenzothiazole, 5-phethylbenzothiazole, 5-fluorobenzothiazole, 5-chloro-6-methylbenzothiazole, 5-trifluoromethylbenzothiazole, 5,6-dimethylbenzothiazole, 5-hydroxy-6-methylbenzothiazole, etc. Examples of the naphthothiazole nucleus are naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 5-methoxynaphtho[2,3-d]thiazole, etc. Examples of the benzoselenazole nucleus are benzoselenazole, 5-chlorobenzoselenazole, 5-nitrobenzoselenazole, 5-methoxybenzoselenazole, 5-ethoxybenzoselenazole, 5-hydroxybenzoselenazole, 5-chloro-6-methylbenzoselenazole, etc. Examples of the naphthoselenazole nucleus are naphtho[1,2-d]selenazole, naphtho[2,1-d]selenazole, etc. Examples of the thiazole nucleus are a thiazole nucleus, a 4-methylthiazole nucleus, a 4-phenylthiazole nucleus, a 4,5-dimethylthiazole nucleus, a 4,5-diphenylthiazole nucleus, etc. Examples of the thiazoline nucleus are a thiazoline nucleus, a 4-methylthiazoline nucleus, etc.

In regard to $Z_{71}$, $Z_{72}$, $Z_{81}$, and $Z_{82}$, examples of the benzoxazole nucleus are a benzoxazole nucleus, a 5-chlorobenzoxazole nucleus, a 5-methylbenzoxazole nucleus, a 5-bromobenzoxazole nucleus, a 5-fluorobenzoxazole nucleus, a 5-phenylbenzoxazole nucleus, a 5-methoxybenzoxazole nucleus, a 5-ethoxybenzoxazole nucleus, a 5-trifluoromethylbenzoxazole nucleus, a 5-hydroxybenzoxazole nucleus, a 5-carboxybenzoxazole nucleus, a 6-methylbenzoxazole nucleus, a 6-chlorobenzoxazole nucleus, a 6-methoxybenzoxazole nucleus, a 6-hydroxybenzoxazole nucleus, a 5,6-dimethylbenzoxazole nucleus, etc. Examples of the naphthoxazole nucleus are a naphtho[2,1-d]oxazole nucleus, a naphtho[1,2-d]oxazole nucleus, a naphtho[2,3-d]oxazole nucleus, a 5-methoxynaphtho[1,2-d]oxazole nucleus, etc.

Furthermore, in regard to $Z_{71}$ and $Z_{72}$, examples of the oxazole nucleus are an oxazole nucleus, a 4-methyloxazole nucleus, a 4-ethyloxazole nucleus, a 4-phenyloxazole nucleus, a 4-benzyloxazole nucleus, a 4-methoxyoxazole nucleus, a 4,5-dimethyloxazole nucleus, a 5-phenyloxazole nucleus, a 4-methoxyoxazole nucleus, etc. Examples of the pyridine nucleus are a 2-pyridine nucleus, a 4-pyridine nucleus, a 5-methyl-2-pyridine nucleus, a 3-methyl-4-pyridine nucleus, etc. Examples of the quinoline nucleus are a 2-quinoline nucleus, a 4-quinoline nucleus, a 3-methyl-2-quinoline nucleus, a 5-ethyl-2-quinoline nucleus, a 6-methyl-2-quinoline nucleus, an 8-fluoro-4-quinoline nucleus, an 8-chloro-2-quinoline nucleus, an 8-fluoro-2-quinoline nucleus, a 6-methoxy-2-quinoline nucleus, a 6-ethoxy-4-quinoline nucleus, an 8-chloro-4-quinoline nucleus, an 8-methyl-4-quinoline nucleus, an 8-methoxy-4-quinoline nucleus, etc.

Examples of the indoline nucleus shown by $Z_{61}$ are a 3,3-dialkylindoline (e.g., a 3,3-dimethylindoline, 3,3-diethylindoline, 3,3-dimethyl-5-cyanoindoline, 3,3-dimethyl-6-nitroindoline, 3,3-dimethyl-5-nitroindoline, 3,3-dimethyl-5-methoxyindoline, 3,3-dimethyl-5-methylindoline, 3,3-dimethyl-5-chloroindoline, etc.).

Also, $Z_9$ is a non-metallic atomic group necessary for completing the thiazoline nuclei (e.g., thiazoline, 4-methylthiazoline, 4-phenylthiazoline, 4,5-dimethylthiazoline, 4,5-diphenylthiazoline, etc.), a benzothiazoline nucleus (e.g., benzothiazoline, 4-chlorobenzothiazoline, 5-chlorobenzothiazoline, 6-chlorobenzothiazoline, 7-chlorobenzothiazoline, 5-nitrobenzothiazoline, 6-nitrobenzothiazoline, 4-methylbenzothiazoline, 5-methylbenzothiazoline, 6-methylbenzothiazoline, 5-bromobenzothiazoline, 6-bromobenzothiazoline, 5-iodobenzothiazoline, 5-methoxybenzothiazoline, 6-methoxybenzothiazoline, 5-ethoxybenzothiazoline, 5-propoxybenzothiazoline, 5-butoxybenzothiazoline, 5-carboxybenzothiazoline, 5-ethoxycarbonylbenzothiazoline, 5-phenethylbenzothiazoline, 5-fluorobenzothiazoline, 5-chloro-6-methylbenzothiazoline, 5-trifluoromethylbenzothiazoline, 5,6-dimethylbenzothiazoline, 5-hydroxy-6-methylbenzothiazoline, tetrahydrobenzothiazoline, 4-phenylbenzothiazoline, 5-phenylbenzothiazoline, etc.), the naphthothiazoline nucleus (e.g., naphtho[2,1-d]thiazoline, naphtho[1,2-d]thiazoline, naphtho[2,3-d]thiazoline 5-methoxynaphtho[1,2-d]thiazoline, 7-ethoxynaphtho[2,1-d]thiazoline, 8-methoxynaphtho[2,1-d]thiazoline, 5-methoxynaphtho[2,3-d]thiazoline, etc.), the thiazolidine nucleus (e.g., thiazolidine, 4-methylthiazolidine, 4-nitrothiazolidine, etc.), the oxazoline nucleus (e.g., oxazoline, 4-methyloxazoline, 4-nitroxazoline, 5-methyloxazoline, 4-phenyloxazoline, 4,5-diphenyloxazoline, 4-ethyloxazoline, etc.), the benzoxazoline nucleus (e.g., benzoxazoline, 5-chlorobenzoxazoline, 5-methylbenzoxazoline, 5-bromobenzoxazoline, 5-fluorobenzoxazoline, 5-phenylbenzoxazoline, 5-methoxybenzoxazoline, 5-nitrobenzoxazoline, 5-trifluoromethylbenzoxazoline, 5-hydroxybenzoxazoline, 5-carboxybenzoxazoline, 6-methylbenzoxazoline, 6-chlorobenzoxazoline, 6-nitrobenzoxazoline, 6-methoxybenzoxazoline, 6-hydroxybenzoxazoline, 5,6-dimethylbenzoxazoline, 5-ethoxybenzoxazoline, etc.), the naphthoxazoline nucleus (e.g., naphtho[2,1-d]oxazoline, naphtho[1,2-d]oxazoline, naphtho[2,3-d]oxazoline, 5-nitronaphtho[2,1-d]oxazoline, etc.), the oxazolidine nucleus (e.g., 4,4-dimethyloxazolidine, etc.), the selenazoline nucleus (e.g., 4-methylselenazoline, 4-nitroselenazoline, 4-phenylselenazoline, etc.), the selenazolidine nucleus (e.g., selenazolidine, 4-methylselenazolidine, 4-phenylselenazolidine, etc.), the benzoselenazoline nucleus (e.g., benzoselenazoline, 5-chlorobenzoselenazoline, 5-nitrobenzoselenazoline, 5-methoxybenzoselenazoline, 5-hydroxybenzoselenazoline, 6-nitrobenzoselenazoline, 5-chloro-6-nitrobenzoselenazoline, etc.), the naphthoselenazoline nucleus (e.g., naphtho[2,1-d]selenazoline, naphtho[1,2-d]selenazoline, etc.), the 3,3-dialkylindoline nucleus (e.g., 3,3-dimethylindoline, 3,3-diethylindoline, 3,3-dimethyl-5-cyanoindoline, 3,3-dimethyl-6-nitroindoline, 3,3-dimethyl-5-nitroindoline, 3,3-dimethyl-5-methoxyindoline, 3,3-dimethyl-5-methylindoline, 3,3-dimethyl-5-chloroindoline, etc.), the imidazoline nucleus (e.g., 1-alkylimidazoline, 1-alkyl-4-phenylimidazoline, 1-arylimidazoline, etc.), the benzimidazoline nucleus (e.g., 1-alkylbenzimidazoline, 1-alkyl-5-chlorobenzimidazoline, 1-alkyl-5,6-dichlorobenzimidazoline, 1-alkyl-5-methoxybenzimidazoline, 1-alkyl-5-cyanobenzimidazoline, 1-alkyl-5-fluorobenzimidazoline, 1-alkyl-5-trifluoromethylbenzimidazoline, 1-allyl-5,6-dichlorobenzimidazoline, 1-allyl-5-chlorobenzimidazoline, 1-arylbenzimidazoline, 1-aryl-5-chlorobenzimidazoline, 1-aryl-5,6-dichlorobenzimidazoline, 1-aryl-5-methoxybenzimidazoline, 1-aryl-5-cyanobenzimidazoline, etc.), the naphtimidazoline nucleus (e.g., 1-alkylnaphtho[1,2-d]imidazoline, 1-arylnaphtho[1,2-d]imidazoline, etc.) [the foregoing alkyl group is preferably an unsubstituted alkyl group having 1 to 8 carbon atoms such as a methyl group, an ethyl group, a propyl group, an isopropyl group, a butyl group, etc., or a hydroxyalkyl group such as a 2-hydroxyethyl group, a 3-hydroxypropyl group, etc., and the above-described aryl group is preferably a phenyl group, a phenyl group substituted by a halogen atom (e.g., chlorine), a phenyl group substituted by an alkyl group (e.g., methyl group), or a phenyl group substituted by an alkoxy group (e.g., methoxy group)], the pyrrolidine nucleus (e.g., 2-pyrrolidine, etc.), the dihydropyridine nucleus (e.g., 1,4-dihydropyridine, 5-methyl-1,2-dihydropyridine, 3-methyl-1,4-dihydropyridine, etc.), the dihydroquinoline nucleus (e.g., 1,4-dihydroquinoline, 3-methyl-1,2-dihydroquinoline, 5-ethyl-1,2-dihydroquinoline, 6-methyl-1,2-dihydroquinoline, 6-nitro-1,2-dihydroquinoline, 8-fluoro-1,2-dihydroquinoline, 6-methoxy-1,2-dihydroquinoline, 6-hydroxy-1,2-dihydroquinoline, 8-chloro-1,2-dihydroquinoline, 6-ethoxy-1,4-dihydroquinoline, 6-nitro-1,4-dihydroquinoline, 8-chloro-1,4-dihydroquinoline, 8-fluoro-1,4-dihydroquinoline, 8-methyl-1,4-dihydroquinoline, 8-methoxy-1,4-dihydroquinoline, dihydroisoquinoline, 6-nitro-1,2-isoquinoline, 6-nitro-2,3-dihydroisoquinoline, etc.), and the tetrazoline nucleus.

Preferred nuclei in the above-described nuclei are the thiazoline nucleus, the benzothiazoline nucleus, the thiazolidine nucleus, the benzoxazoline nucleus, the naphthoxazoline nucleus, the selanazoline nucleus, the selenazolidine nucleus, the benzoselenazoline nucleus, the benzimidazoline nucleus, the pyrrolidine nucleus, the dihydropyridine nucleus, and the tetrazoline nucleus. Particularly preferred nuclei are the thiazoline nucleus, the thiazolidine nucleus, the selenazoline nucleus, the selanazolidine nucleus, the benzimidazoline nucleus, the pyrrolidine nucleus, and the dihydropyridine nucleus. More particularly preferred nuclei are the thiazoline nucleus, the thiazolidine nucleus, the benzimidazoline nucleus, and the pyrrolidine nucleus.

$R_{91}$ and $R_{92}$ each is a hydrogen atom, an unsubstituted alkyl group (having from 1 to 18 carbon atoms, and preferably from 1 to 8 carbon atoms, such as a methyl group, an ethyl group, a propyl group, an isopropyl group, a butyl group, a hexyl group, a dodecyl group, an octadecyl group, etc.) or a substituted alkyl group such as an aralkyl group (e.g., a benzyl group, a β-phenylethyl group, etc.), a hydroxyalkyl group (e.g., a 2-hydroxyethyl group, a 3-hydroxypropyl group, a 2-hydroxyethoxyethyl group, etc.), a carboxyalkyl group (e.g., a carboxymethyl group, a 2-carboxyethyl group, a 3-carboxypropyl group, a 4-carboxybutyl group, etc.), a sulfo group-substituted alkyl group, said sulfo group may be bonded to the alkyl group through at least one alkoxy group or an aryl group, such as a 2-sulfoethyl group, a 3-sulfopropyl group, a 3-sulfobutyl group, a 4-sulfobutyl group, a 2-[3-sulfopropoxy]ethyl ggroup, a 2-hydroxy-3-sulfopropyl group, a 2-[2-(3-sulfopropoxy)ethoxy]ethyl group, a p-sulfophenethyl group, etc.), a sulfate alkyl group (e.g., a 3-sulfate propyl group, a 4-sulfate butyl group, etc.), a vinyl group-substituted alkyl group (e.g., an allyl group, etc.), an acyloxyalkyl group (e.g., a 2-acetoxyethyl group, a 3-acetoxypropyl group, etc.), an alkoxyalkyl group (e.g., a 2-methoxyethyl group, a 3-methoxypropyl group, etc.), an alkoxycarbonylalkyl group (e.g., a 2-methoxycarbonylethyl group, a 3-methoxycarbonyl propyl group, a 4-ethoxycarbonylbutyl group, etc.), a cyanoalkyl group (e.g., a 2-cyanoethyl group, etc.), a carbamoyl alkyl group (e.g., a 2-carbamoylethyl group, etc.), an aryloxy alkyl group (e.g., a 2-phenoxyethyl group, a 3-phenoxypropyl group, etc.), a mercaptoalkyl group (e.g., a 2-mercaptoethyl group, a 3-mercaptopropyl group, etc.), an alkylthioalkyl group (e.g., a 2-methylthioethyl group, etc.), etc. $R_{91}$ and $R_{92}$ each represents also an aryl group such as a phenyl group, a tolyl group, a naphthyl group, a methoxyphenyl group, a chlorophenyl group, etc. $R_{92}$ is preferably a hydrogen atom or an allyl group.

Q represents a nonmetallic atomic group necessary for completing a rhodanine nucleus, a 2-thiooxazoline-2,4-dione nucleus, a 2-thioselenazoline-2,4-dione nucleus, a barbituric acid or thiobarbituric acid nucleus, for example, a barbituric acid or thiobarbituric acid nucleus containing a 1-alkyl group (e.g., a 1-methyl group, a 1-ethyl group, a 1-propyl group, a 1-butyl group, etc.), a 1,3-dialkyl group (e.g., a 1,3-dimethyl group, a 1,3-diethyl group, a 1,3-dipropyl group, a 1,3-diisopropyl group, a 1,3-dicyclohexyl group, a 1,3-di(β-methoxyethyl) group, etc.), a 1,3-diaryl group (e.g., a 1,3-diphenyl group, a 1,3-di(p-chlorophenyl) group, a 1,3-di(p-ethoxycarbonylphenyl) group, etc.), a 1-sulfoalkyl group (e.g., a 1-(2-sulfoethyl) group, a 1-(3-sulfopropyl) group, a 1-(4-sulfobutyl) group, etc.), a 1,3-disulfoalkyl group (e.g., 1,3-di(2-sulfoethyl) group, a 1,3-di(3-sulfopropyl) group, a 1,3-di(4-sulfocyclohexyl) group, etc.), etc.), a 1,3-di(sulfoaryl) group (e.g., a 1,3-di-(4-sulfophenyl) group, etc.), or a 1-sulfoaryl group (e.g., a 1-(4-sulfophenyl) group, etc.), or a thiohydantoin nucleus (the substituent at the 1st position has the same meanings so that at the 3rd position ($R_{92}$) and they may be the same or different).

The heterocyclic ring formed by Q is preferably a rhodanine nucles or a thiohydantoin nucleus, and more preferably is a rhodanine nucleus.

$Y_{91}$ and $Y_{92}$ each represents a hydrogen atom, an alkyl group which may be substituted with a substituent such as for $R_{11}$ and $R_{12}$ (e.g., a methyl group, an ethyl group, a propyl group, a benzyl group, etc.), or an aryl group which may be substituted with a substituent such as for $R_{11}$ and $R_{12}$ (e.g., a phenyl group, an o-carboxyphenyl group, a p-carboxyphenyl group, etc.).

Carbon number of the above-described substituents of groups defined by $R_{11}$, $R_{12}$, etc., used in formula (I) to (IX) is not critical from the point of view of photographic properties, however, it is preferable not very large from the point of view of solubility of the dyes. For example, the carbon number of an alkoxy group is usually from 1 to 4.

Also, m represents 0, 1 or 2, and p represents 0 or 1.

Among the cyanine dyes and mercyanine dyes represented by formulae (I) to (IX), preferred dyes for attaining the objects of this invention are those represented by formulae (I), (II), (III), (IV), (V), (VI), (VIII) and (IX), more preferred dyes are those represented by formula (I), (IV), and (IX), and the particularly preferred dyes are those represented by formula (IX).

The dyes represented by the above-described formulae having an oxidation potential in the range of from +0.3 to 0.9 volt with respect to a saturated calomel electrode (SCE) are preferred, and the dyes having an oxidation potential in the range of from +0.4 to 0.8 volt are particularly preferred. The oxidation potential of each dye can be measured by a method of performing an electrolytic oxidation about a methanol or acetonitrile solution of dye (the dye concentration of about $10^{-3}$M) using, for example, a 0.1M sodium perchlorate solution as a supporting salt by means of a rotary platinum disc electrode.

The dye is preferably incorporated to an emulsion layer, however, it may also be incorporated to a hydrophilic layer adjacent to the emulsion layer in which the re-reversal negative image is intended to be restrained. Examples of such a hydrophilic layer include a protective layer, an interlayer and a layer containing a dye image forming compound.

The addition amount of the aforesaid dye is preferably in the range of from $1\times10^{-6}$ mole to $5\times10^{-3}$ mole, and more preferably from $2\times10^{-5}$ mole to $1\times10^{-3}$ mole, per mole of silver halide in the silver halide emulsion.

Examples of the cyanine and merocyanine dyes represented by formulae (I) to (IX), which are used as re-reversal restrainer (or inhibitor) in this invention, are illustrated below, but the re-reversal restrainer which are used in this invention are not limited to such dyes.

The compounds shown below having resonance structures but are shown by the limiting structures thereof for convenience.

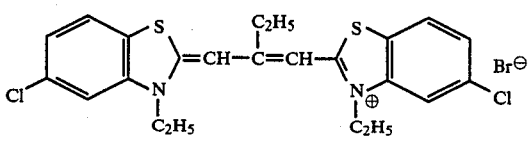
I-1

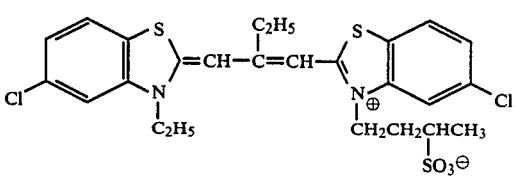
I-2

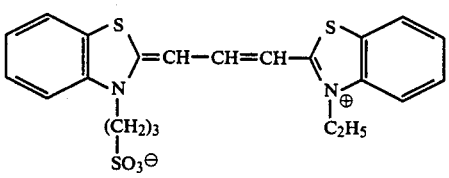
I-3

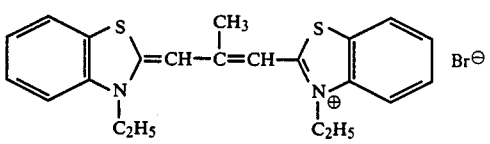
I-4

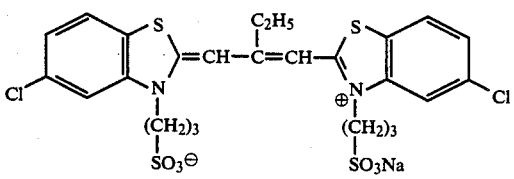
I-5

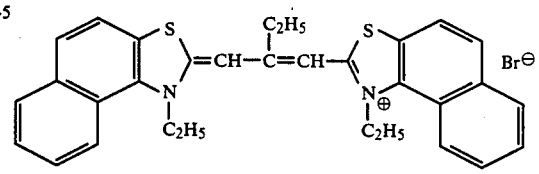
I-6

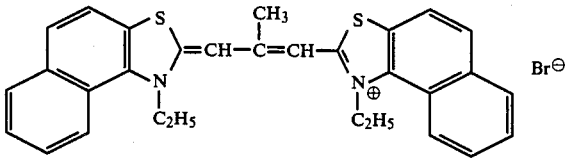
I-7

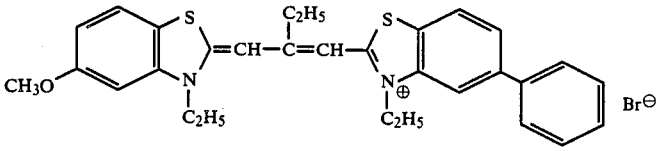
I-8

-continued
I-9
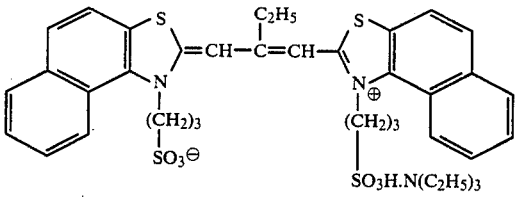
I-10
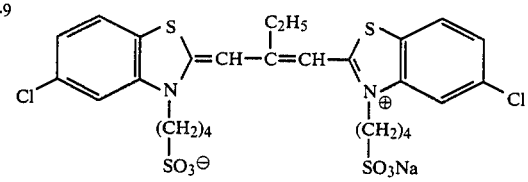
I-11
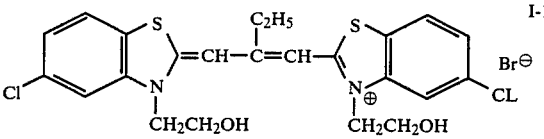
I-12
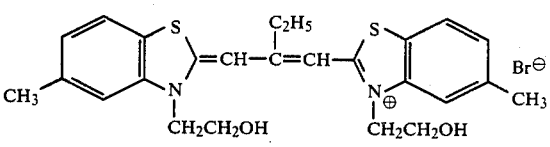
I-13
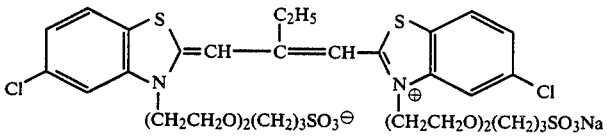
I-14
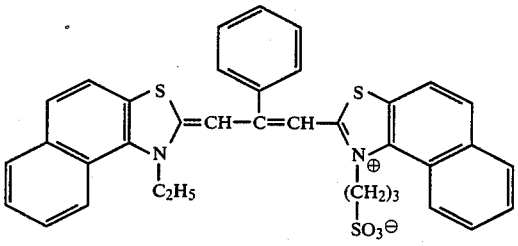
I-15
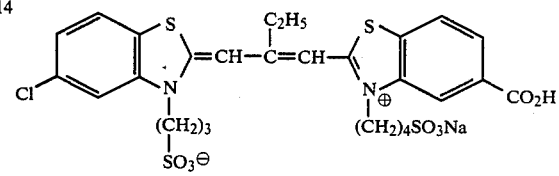
I-16
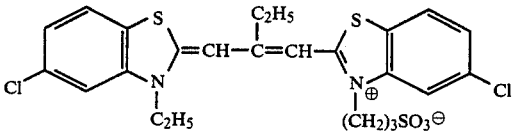
I-17
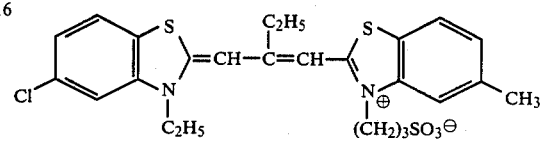
I-18
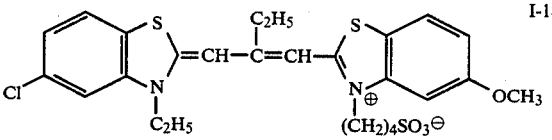
I-19
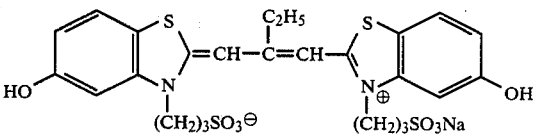
I-20
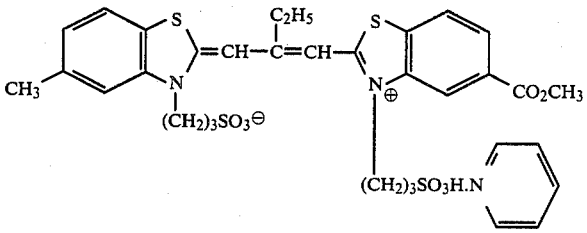
I-21
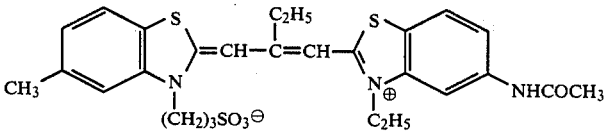
I-22
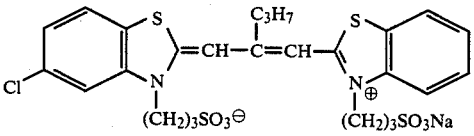
I-23
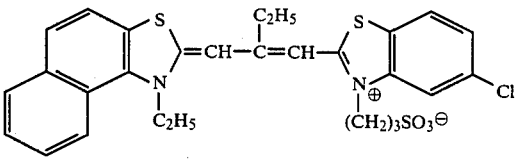

-continued
I-24
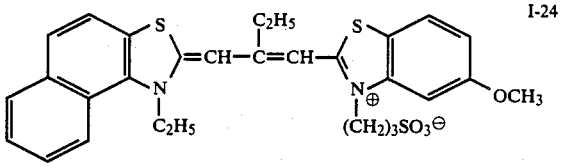
I-25
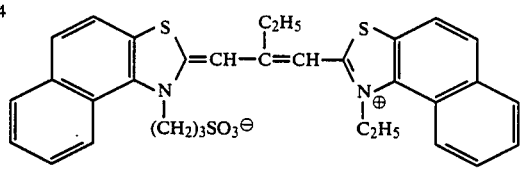
I-26
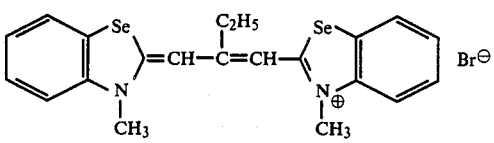
I-27
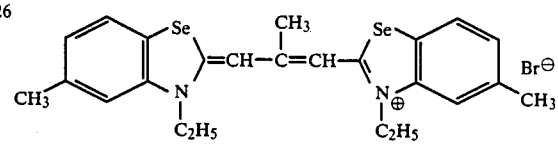
I-28
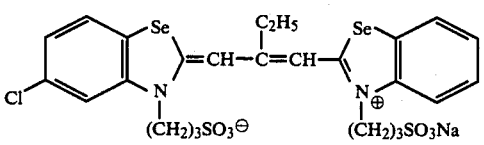
I-29
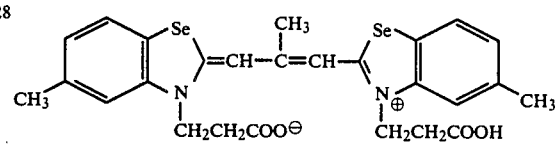
I-30
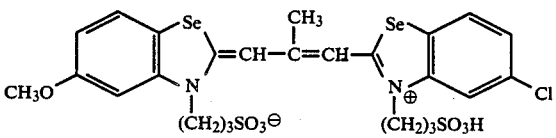
I-31
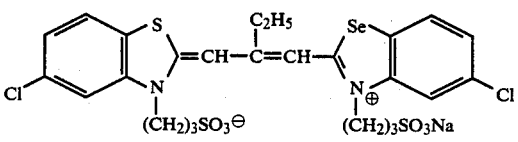
I-32
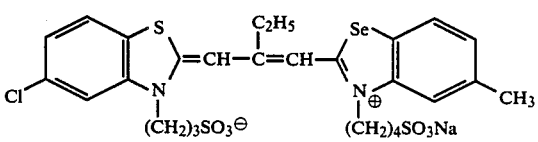
I-33
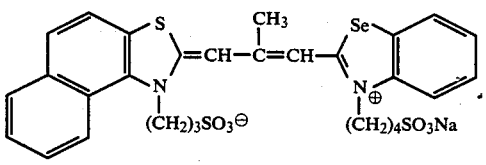
I-34
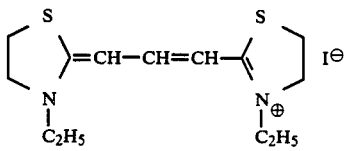
II-1
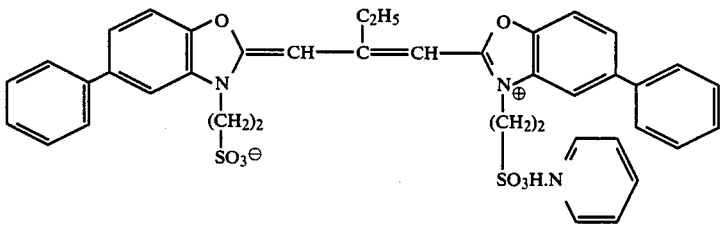
II-2
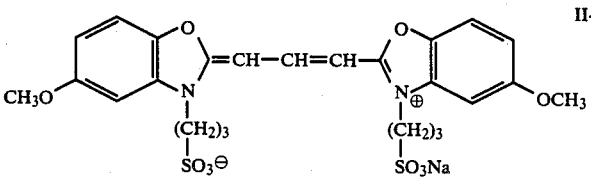
II-3
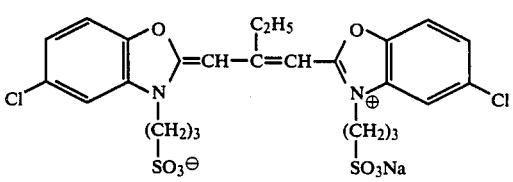
II-4
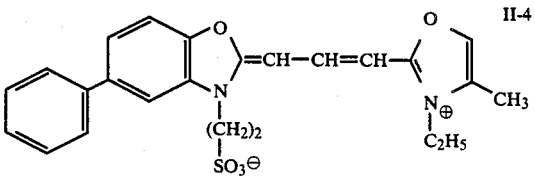
II-5
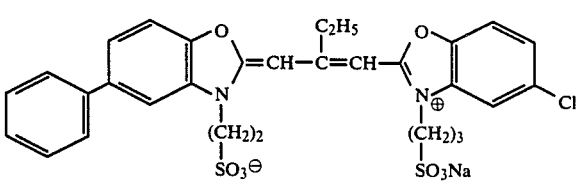

-continued
II-6
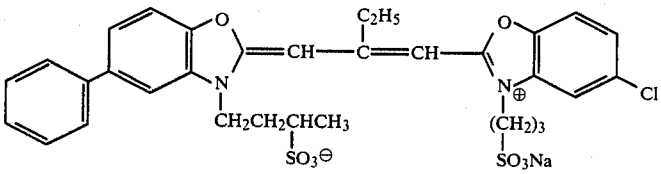
II-7
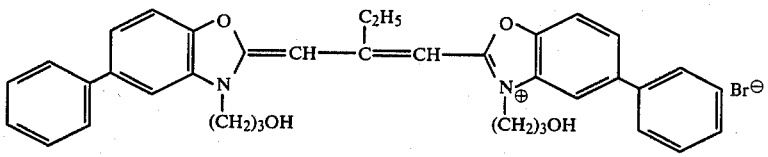
II-8
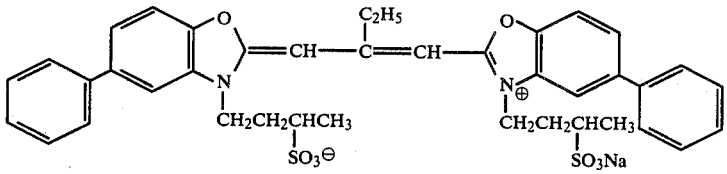
II-9
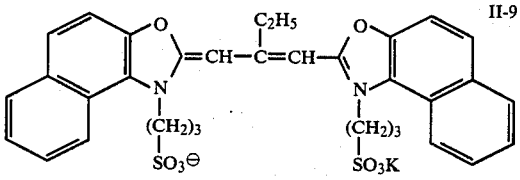
II-10
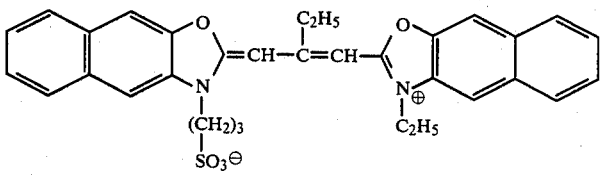
II-11
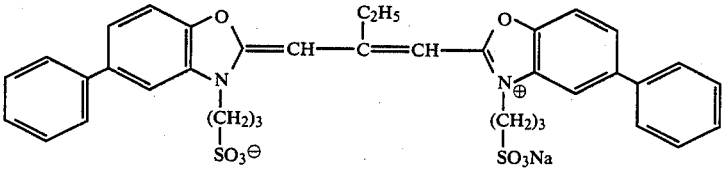
II-12
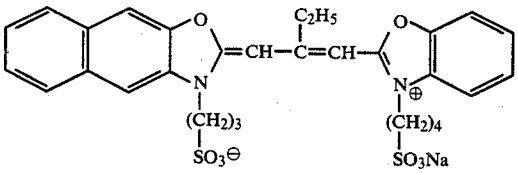
II-13
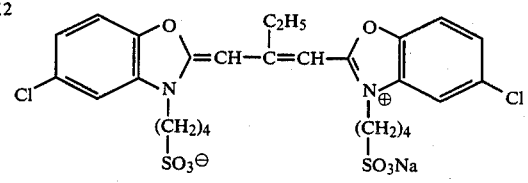
II-14
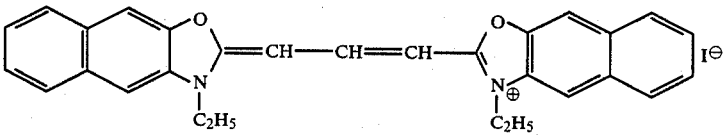
II-15
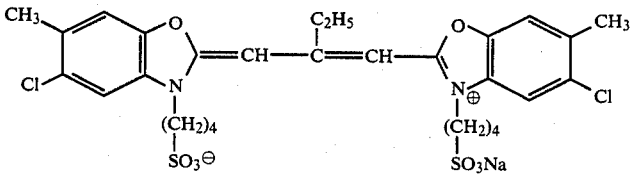

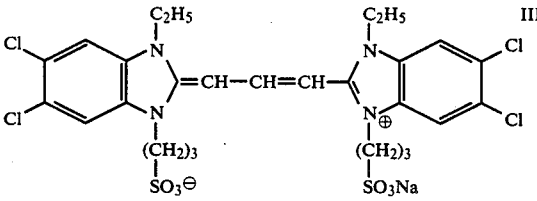
III-1
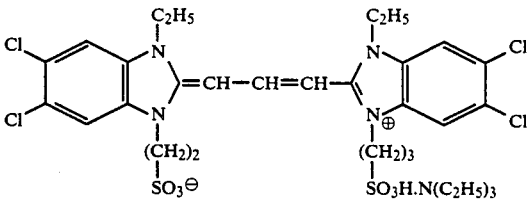
III-2
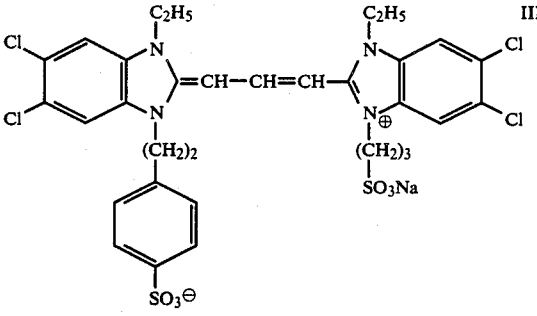
III-3
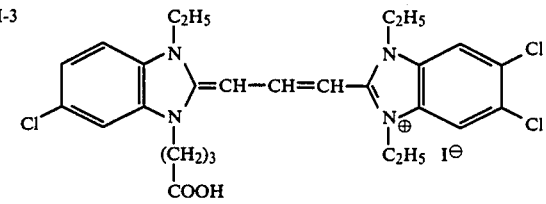
III-4
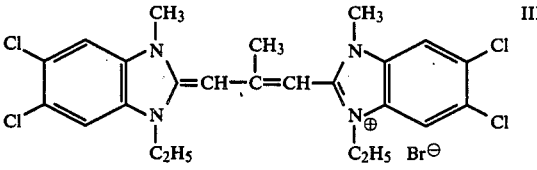
III-5
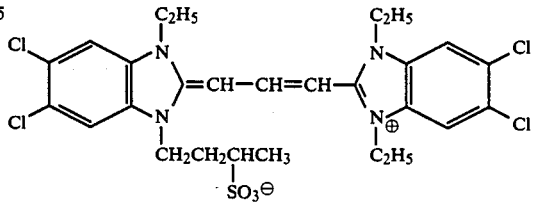
III-6
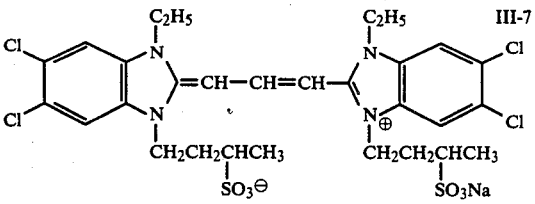
III-7
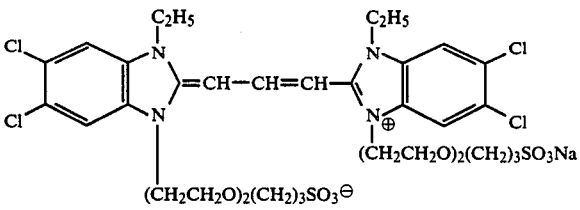
III-8
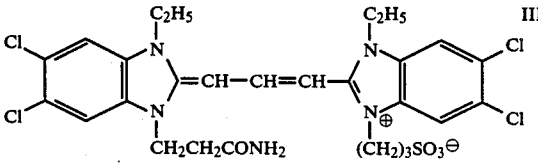
III-9
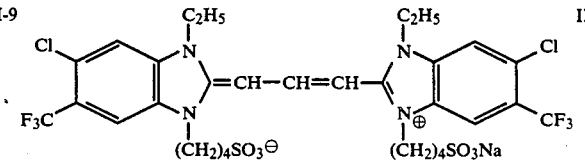
III-10
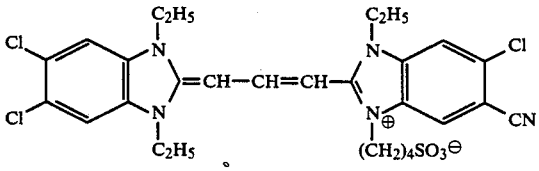
III-11
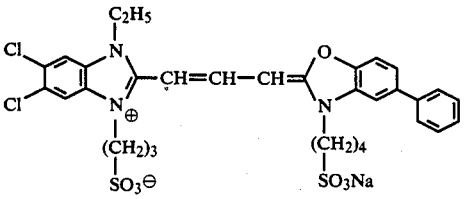
IV-1
-continued
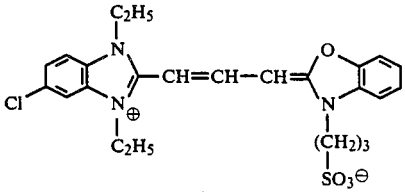
IV-2

-continued
IV-3
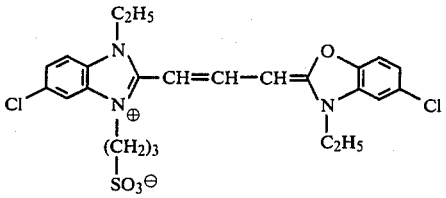
IV-4
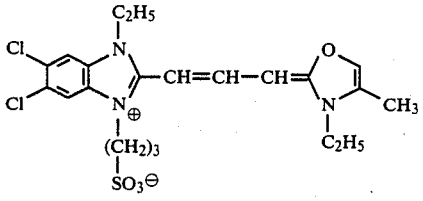
IV-5
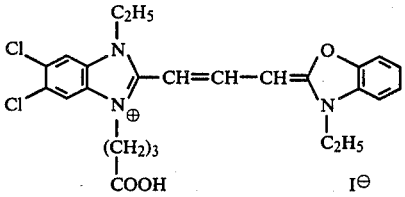
IV-6
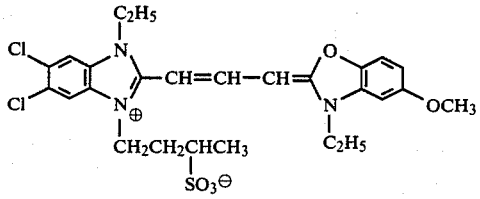
V-1
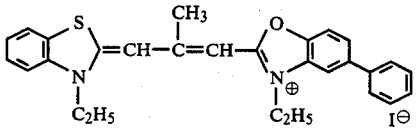
V-2
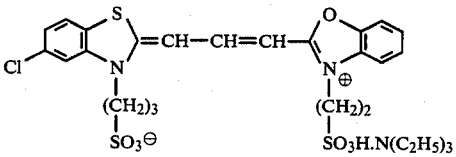
V-3
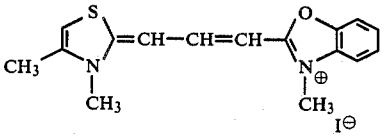
V-4
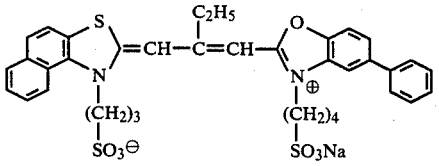
V-5
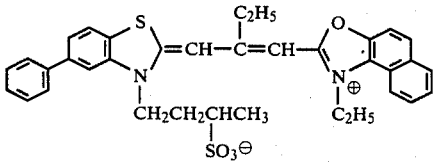
-continued
V-6
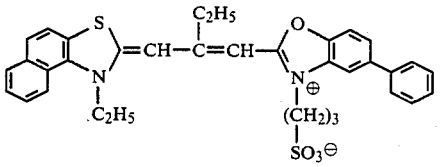
V-7
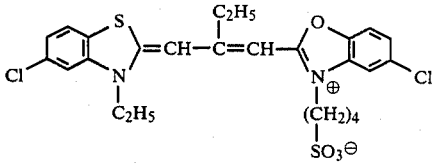
V-8
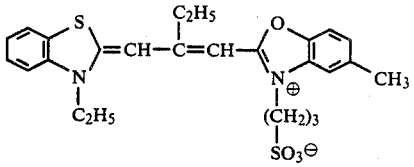
V-9
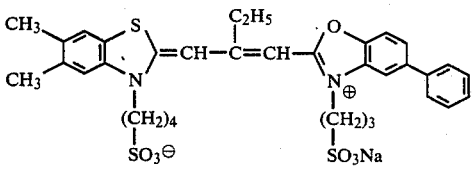
V-10
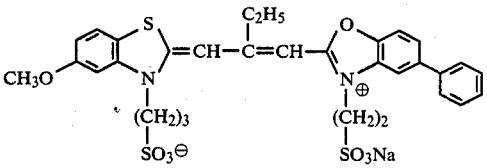
V-11
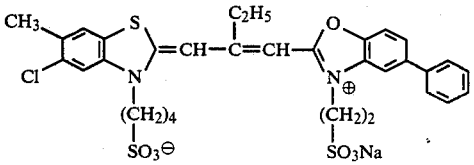
V-12
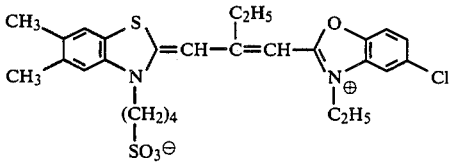
V-13
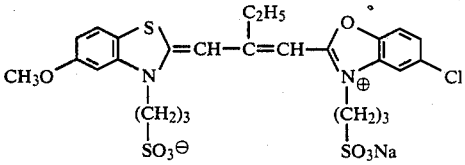
V-14
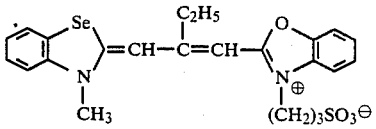

VI-1
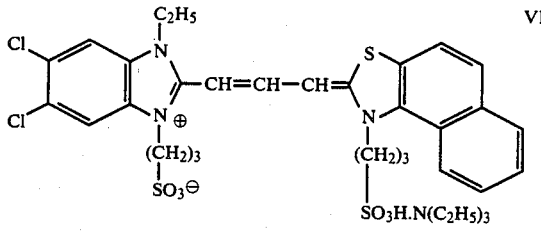
VI-2
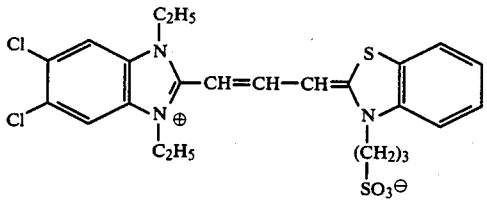
VI-3
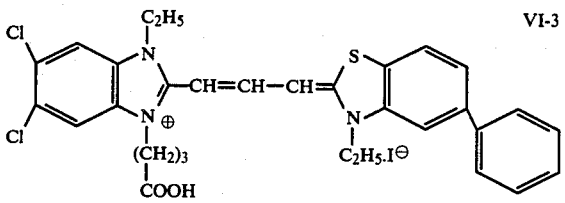
VI-4
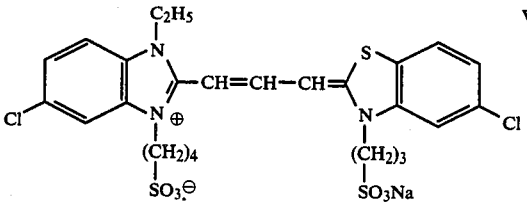
VI-5
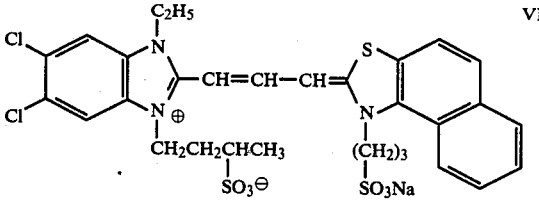
VI-6
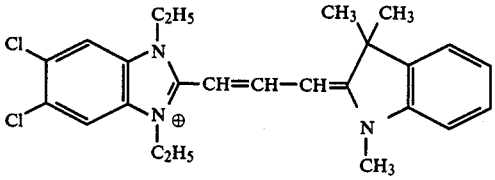
VI-7
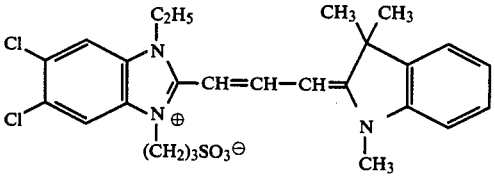
VI-8
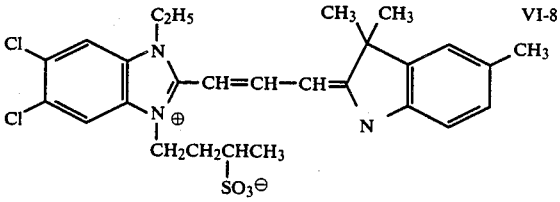
VII-1
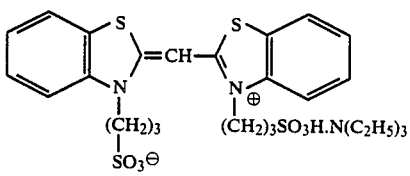
VII-2
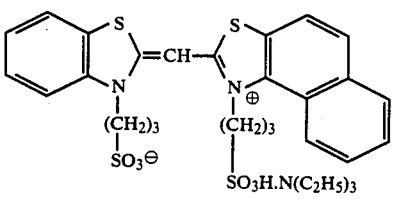
VII-3
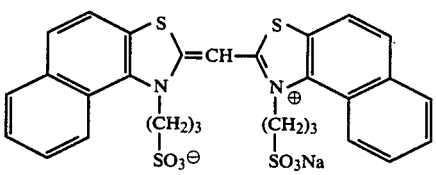
VII-4
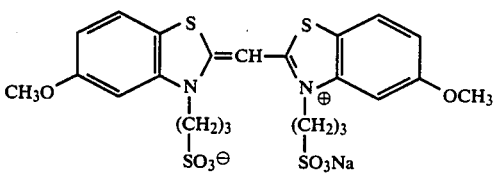
VII-5
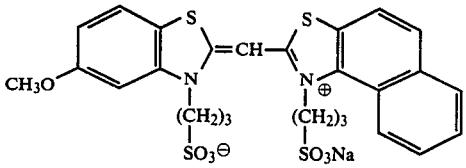
VII-6
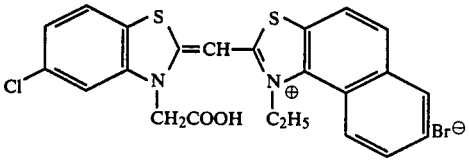
VII-7
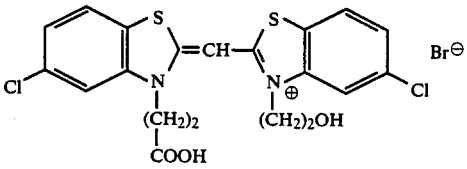
VII-8
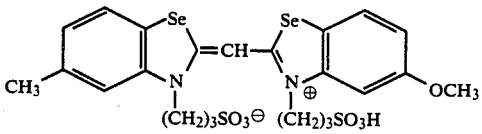
VII-9
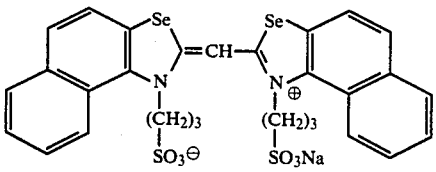

-continued
VII-10
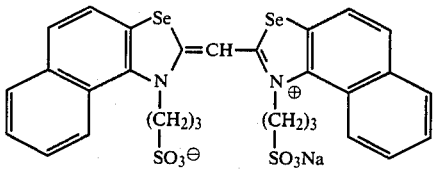
VII-11
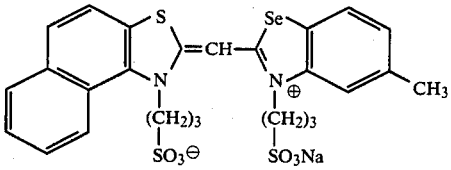
VII-12
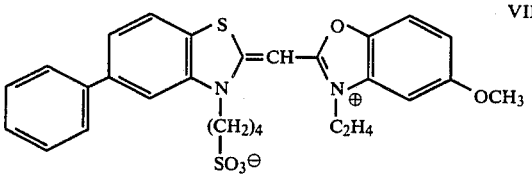
VII-13
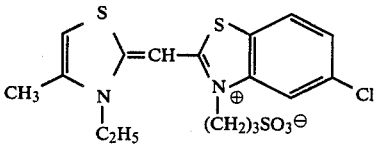
VII-14
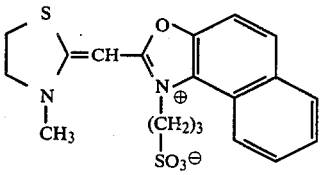
-continued
VII-15
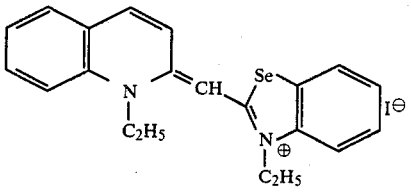
VII-16
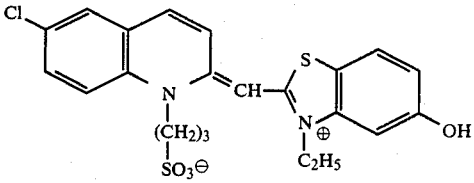
VII-17
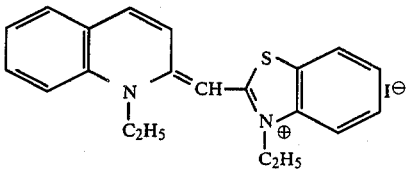
VII-18
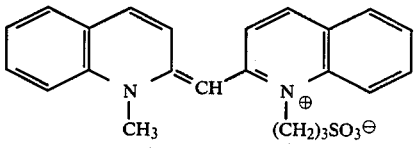
VII-19
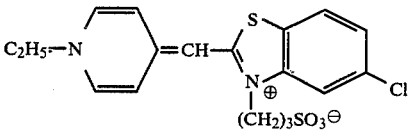
VIII-1
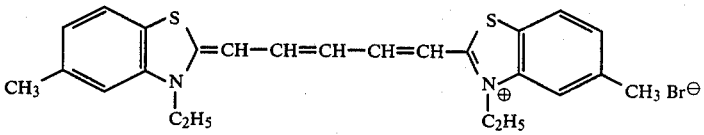
VIII-2
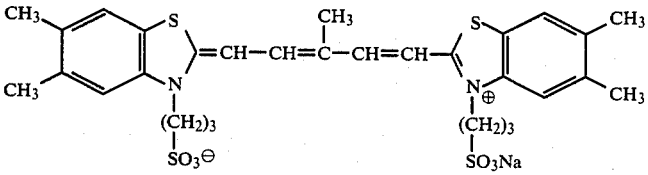
VIII-3
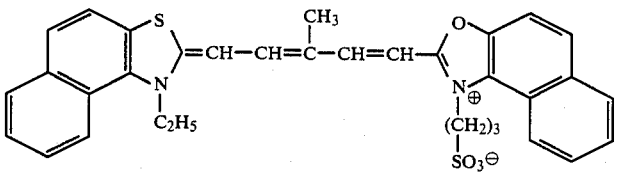

-continued
VIII-4
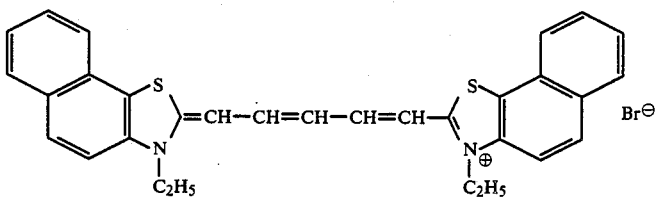
VIII-5
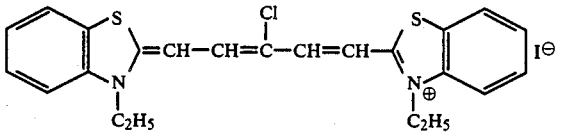
VIII-6
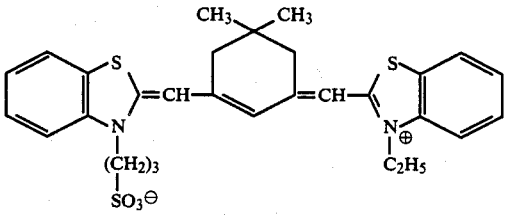
IXa-1
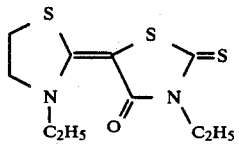
IXa-2
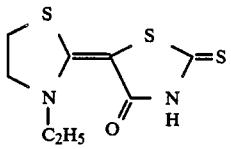
IXa-3
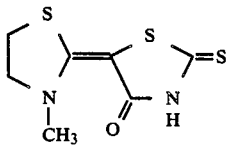
IXa-4
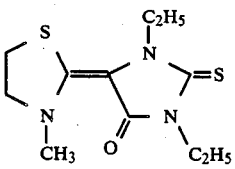
IXa-5
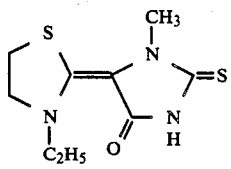
IXa-6
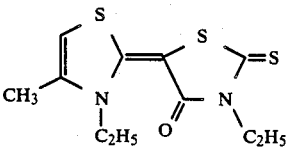
-continued
IXa-7
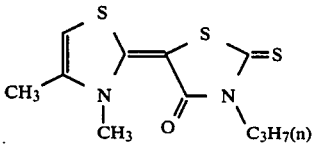
IXa-8
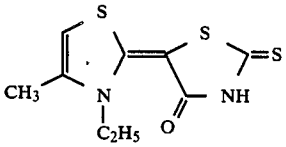
IXa-9
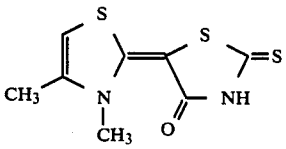
IXa-10
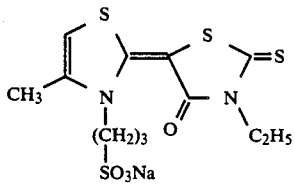
IXa-11
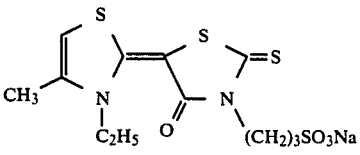
IXa-12
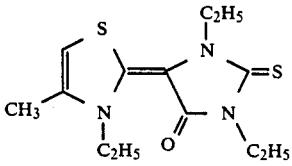

-continued
IXa-13
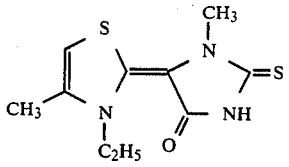
IXa-14
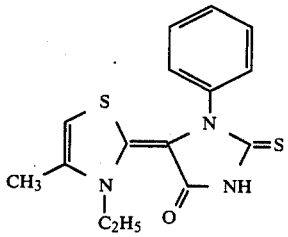
IXa-15
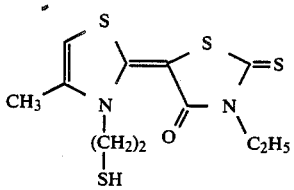
IXa-16
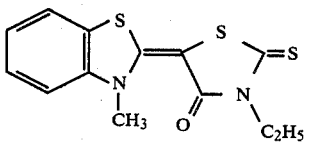
IXa-17
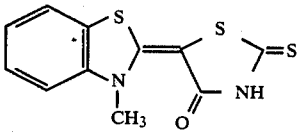
IXa-18
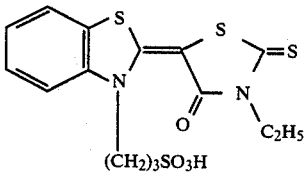
IXa-19
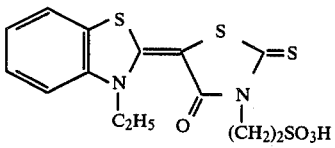
IXa-20
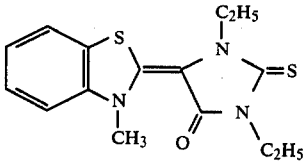
IXa-21
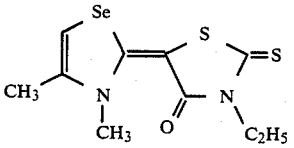
-continued
IXa-22
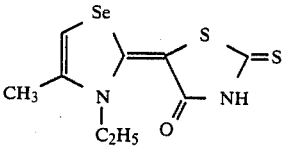
IXa-23
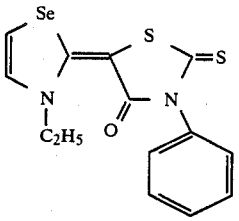
IXa-24
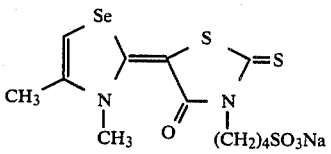
IXa-25
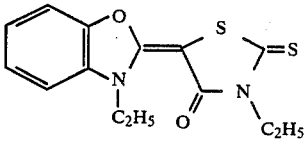
IXa-26
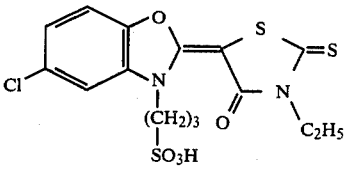
IXa-27
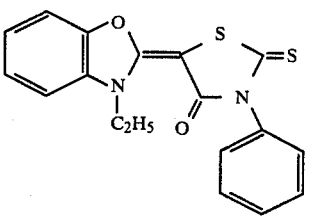
IXa-28
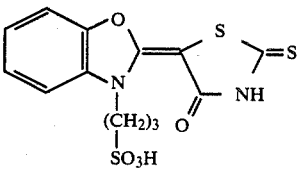
IXa-29
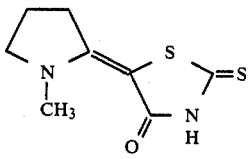
IXa-30
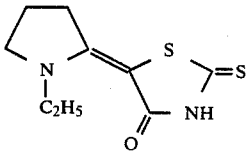

-continued
IXa-31
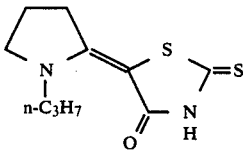
IXa-32
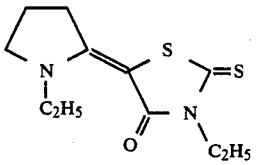
IXa-33
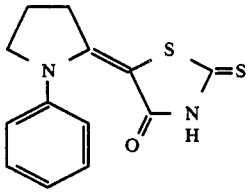
IXa-34
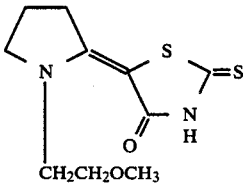
IXa-35
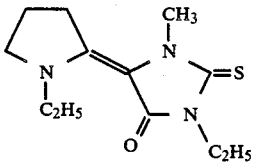
IXa-36
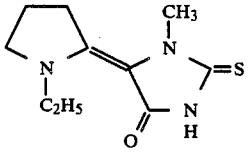
IX-37
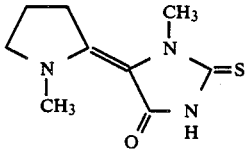
IX-38
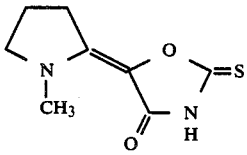
IX-39
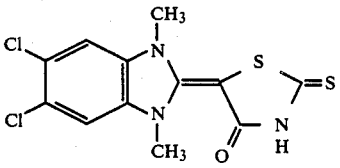
-continued
IXa-40
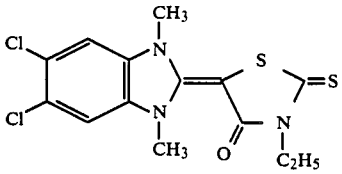
IXa-41
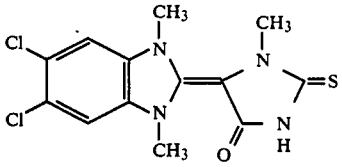
IXa-42
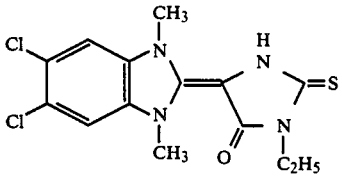
IXa-43
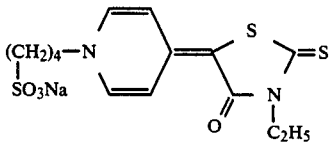
IXa-44
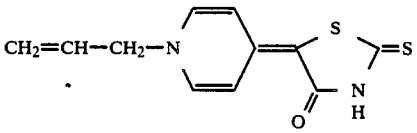
IXa-45
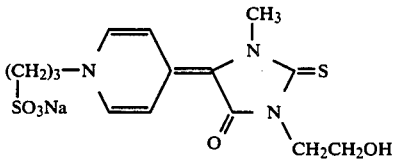
IXa-46
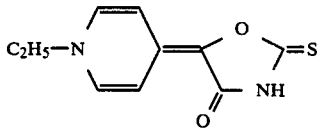
IXa-47
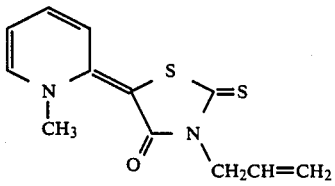
IXa-48
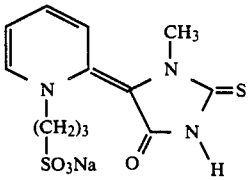

-continued
IXa-49
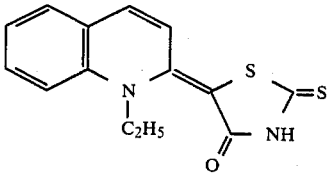
IXa-50
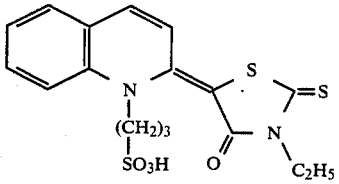
IXa-51
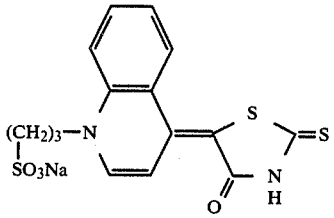
IXb-1
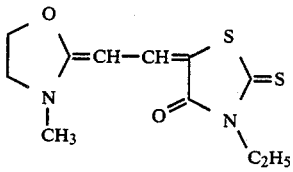
IXb-2
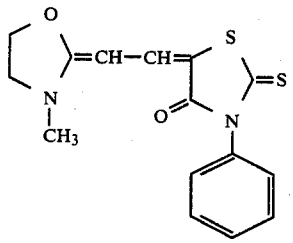
IXb-3
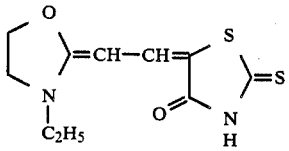
IXb-4
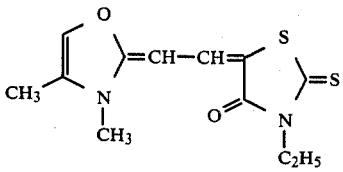
IXb-5
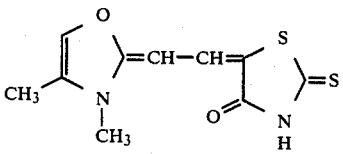
-continued
IXb-6
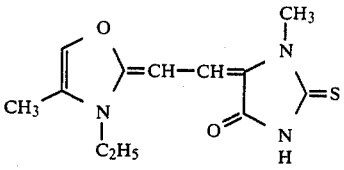
IXb-7
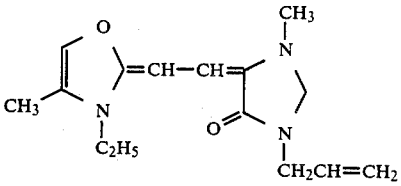
IXb-8
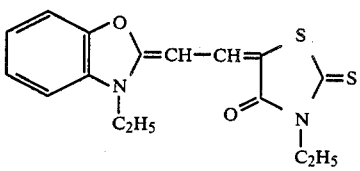
IXb-9
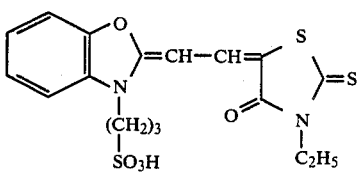
IXb-10
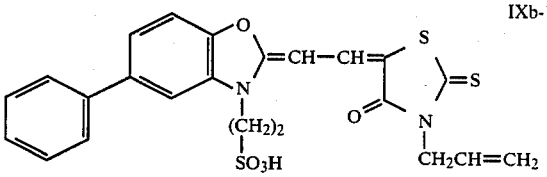
IXb-11
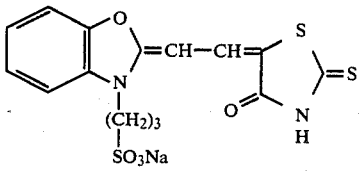
IXb-12
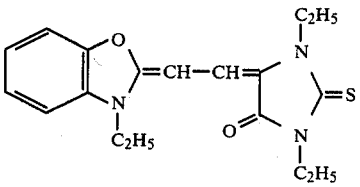
IXb-13
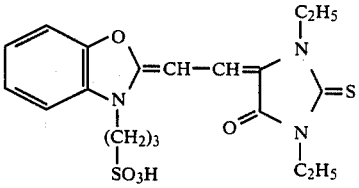

-continued
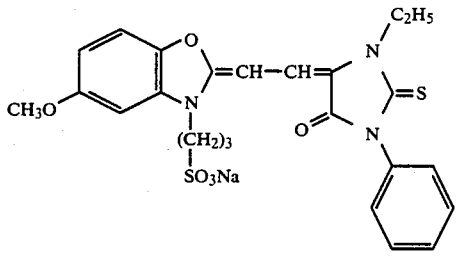
IXb-14
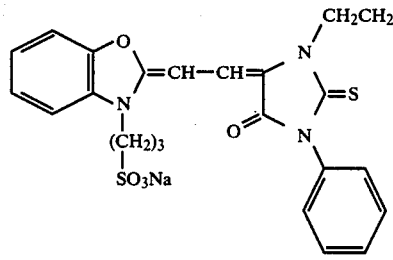
IXb-15
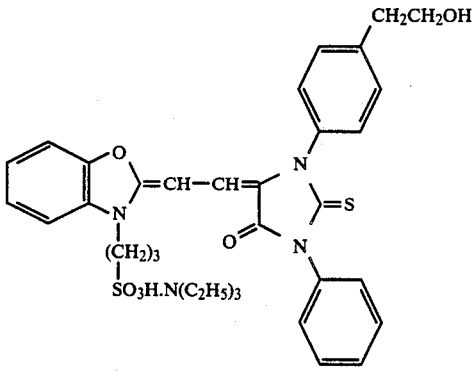
IXb-16
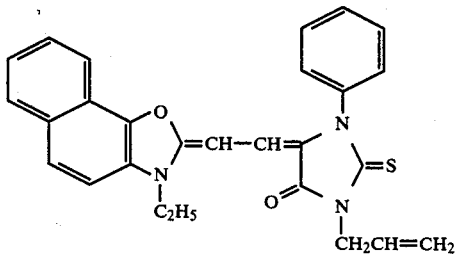
IXb-17
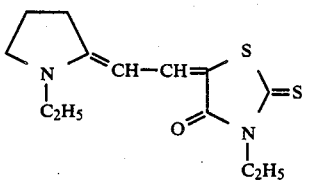
IXb-18
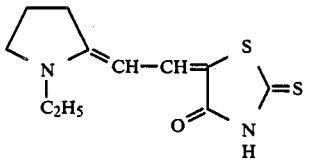
IXb-19
-continued
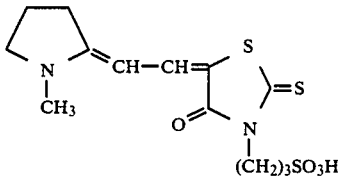
IXb-20
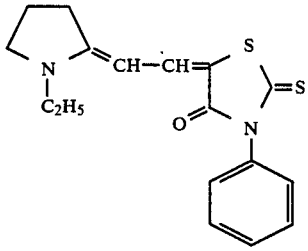
IXb-21
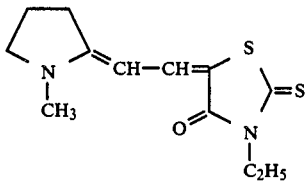
IXb-22
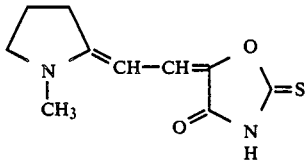
IXb-23
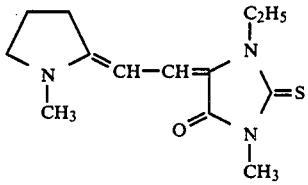
IXb-24
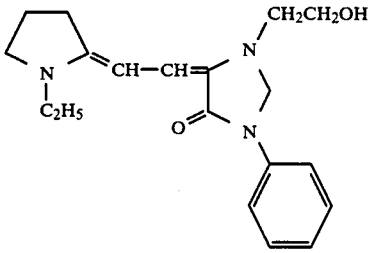
IXb-25
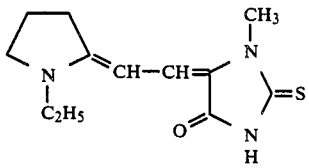
IXb-26

-continued
IXb-27
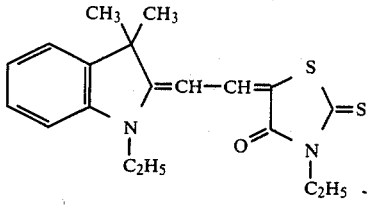
IXb-28
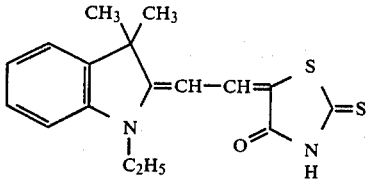
IXb-29
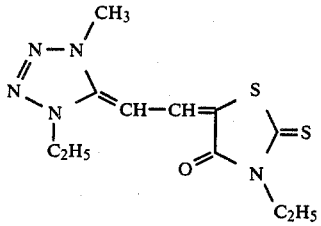
IXb-30
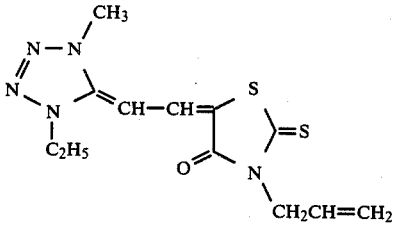
IXb-31
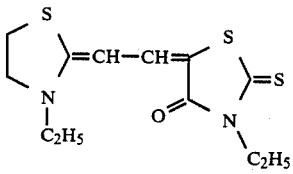
IXb-32
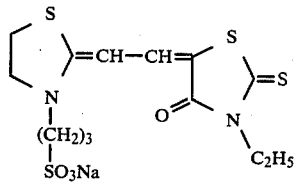
IXb-33
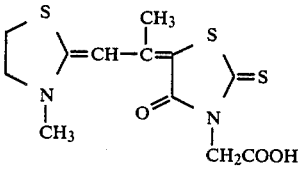
IXb-34
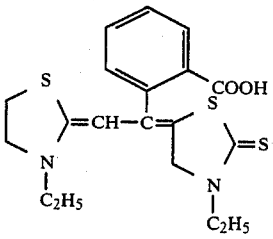
-continued
IXb-35
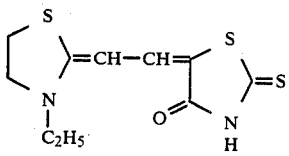
IXb-36
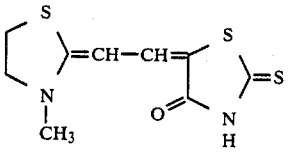
IXb-37
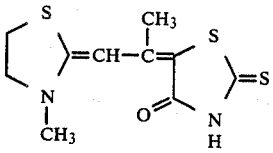
IXb-38
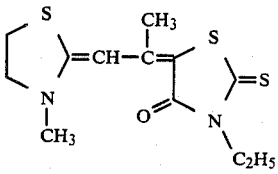
IXb-39
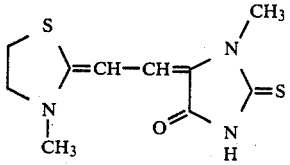
IXb-40
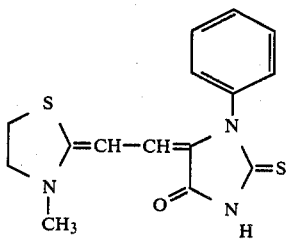
IXb-41
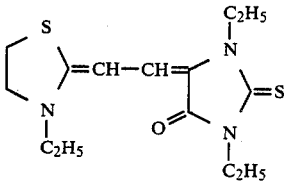
IXb-44
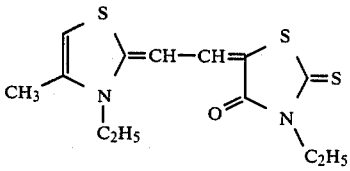

-continued
IXb-45
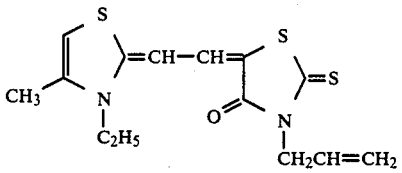
IXb-46
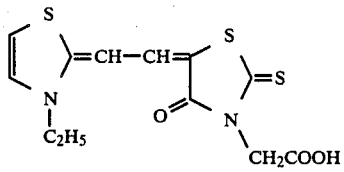
IXb-47
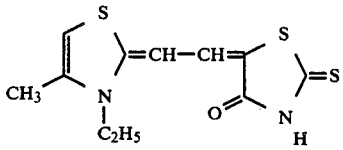
IXb-48
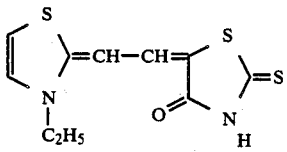
IXb-49
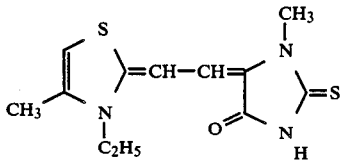
IXb-50
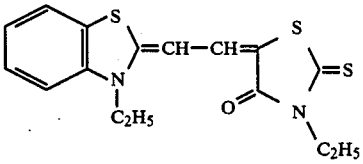
IXb-51
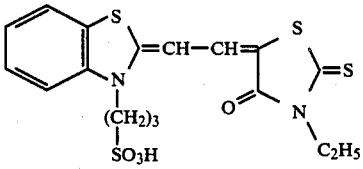
IXb-52
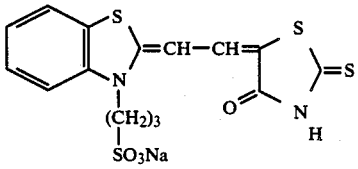
IXb-53
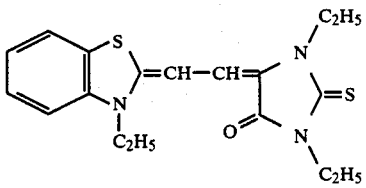
-continued
IXb-54
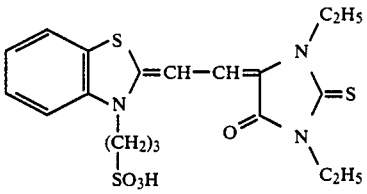
IXb-55
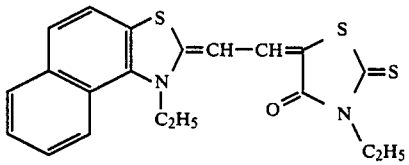
IXb-56
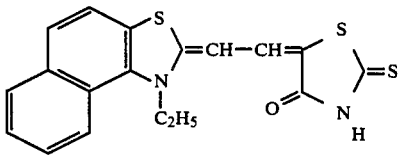
IX c-1
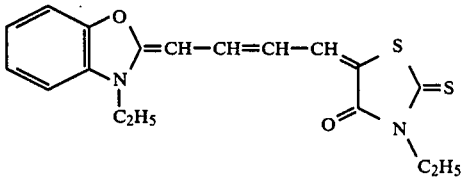
IX c-2
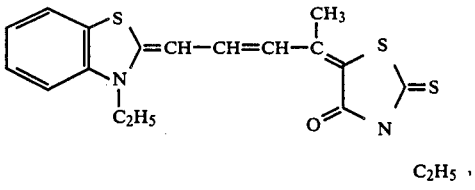
IX c-3
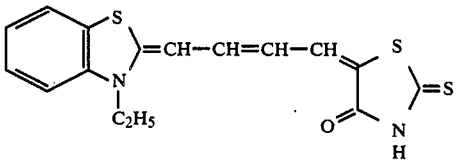
IX c-4
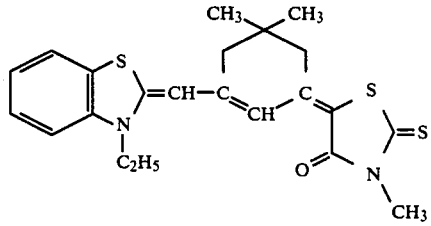
IX c-5
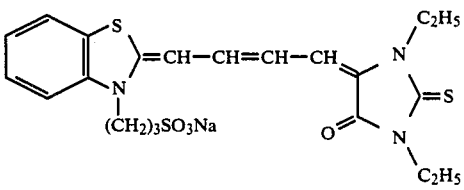

-continued

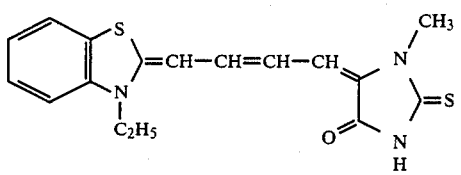

IX c-6

The sensitizing dyes represented by above-described formula (I) to (IX) are described in U.S. Pat. Nos. 2,852,385; 2,694,638; 3,615,635; 2,912,329; 3,364,031; 3,397,060 and 3,506,443; U.K. Pat. No. 1,339,833, etc., and these dyes can be prepared by referring to the methods described in the aforesaid patent specifications and F. M. Hamer; *The Cyanine Dyes and Related Compounds;* published by Interscience Publishers, New York (1964). Also, dyes not specifically described in the above-described patents and technical literature can be prepared by analogous methods to the methods described therein.

As the silver halide compositions for internal latent image type silver halide emulsions which are used in this invention, there are, for example, silver bromide, silver iodide, silver chlorobromide, silver bromoiodide, silver chlorobromo-iodide, etc. A preferred silver halide emulsion is composed of at least 50 mole% silver bromide and the most preferred silver halide emulsion is a silver bromoiodide emulsion containing, preferably, less than about 10 mole% (including 0 mole%) silver iodide. The crystal forms of silver halide grains which are used in this invention include an appropriate globular form regular silver halide grains of a cubic, an octahedral, a tetradecahedral shapes, etc., as well as tabular type silver halide grains having an aspect ratio of 5 to 8 or higher than 8 as shown in *Research Disclosure,* 22534, Jan., 1983 and U.S. Pat. Nos. 4,413,053 and 4,411,986.

The silver halide emulsions which are used in this invention include a silver halide emulsion which is treated by doping with a metal such as copper, cadmium, lead, zinc, etc., as a foreign element in the crystal grains for improving the photographic properties such as re-reversal restrainity, etc., for example, the silver halide emulsion described in U.S. Pat. No. 4,395,478.

The internal latent image type silver halide emulsion can be clearly defined to be a silver halide emulsion wherein the maximum density attained in the case of developing the silver halide emulsion with an "internatl" developer is higher than the maximum density attained in the case of developing the silver halide emulsion with a "surface" developer.

When the internal latent image type silver halide emulsion which is suitably used in this invention is coated on a transparent support and after light-exposing the emulsion layer for a definite time of 0.01 sec. to 1 sec., the emulsion layer is developed for 3 minutes at 20° C. in following developer A (internal developer), the maximum density thereof measured by an ordinary photographic density measuring method is at least 5 times higher than the maximum density obtained in the case developing the silver halide emulsion layer light-exposed as the same manner as described above in following developer B (surface developer). It is preferred that the maximum density of the silver halide emulsion obtained by developing developer A is higher than 10 times the maximum density thereof in the case of developing in developer B.

| | |
|---|---|
| Developer A | |
| Hydroquinone | 15 g |
| Monomethyl-p-aminophenol Sesquisulfate | 15 g |
| Sodium Sulfite | 50 g |
| Potassium Bromide | 10 g |
| Sodium Hydroxide | 25 g |
| Sodium Thiosulfate | 20 g |
| Water to make | 1 liter. |
| Developer B | |
| p-Oxyphenylglycine | 10 g |
| Sodium Carbonate | 100 g |
| Water to make | 1 liter. |

Examples of the internal latent image type silver halide emulsion to which this invention can be applied include a conversion silver halide emulsion prepared by a method (catastrophic precipitation method) of converting silver salt grains having a relatively high solubility, such as silver chloride into silver salt grains having a low solubility, such as silver bromide or silver iodobromide (as described, for example, in U.S. Pat. No. 2,592,250); a core-shell silver halide emulsion prepared by applying a silver halide shell onto chemically sensitized core silver halide grains having large grain size by a method of mixing the core silver halide emulsion with a fine grain silver halide emulsion and then physicaly ripening the mixture (as described, for example, in U.S. Pat. No. 3,206,313); a core/shell silver halide emulsion prepared by applying a silver halide shell onto core silver halide grains by a method of simultaneously adding an aqueous solution of a soluble silver salt and an aqueous solution of a soluble halide to a chemically sensitized mono-dispersed core silver halide emulsion while keeping a constant silver ion concentration (as described, for example, in U.K. Pat. No. 1,027,146 and U.S. Pat. No. 3,761,276); a halogen lacalized silver halide emulsion wherein the silver halide grain is composed of a structure of two or more layers having different halogen composition in the 1st phase and the 2nd phase (as described, for example, in U.S. Pat. No. 3,935,014); and a silver halide emulsion prepared by forming silver halide grains in an acid medium containing a trivalent metal ion, whereby the foreign metal is incorporated in the silver halide grains (as described, for example, in U.S. Pat. No. 3,447,927). Also, the internal latent image type silver halide emulsions in this invention include the internal latent image type emulsions which can be prepared by the methods described in E. T. Wall, *Photographic Emulsions,* pages 35–36 and 52–53, published by American Photographic Publishing, New York (1929); U.S. Pat. Nos. 2,497,875; 2,563,785; and 3,511,662; and West German Patent Application (OLS) No. 2,728,108. Among the internal latent image emulsions, core/shell type silver halide emulsions are particularly suitable for the present invention.

Examples of nucleating agent for these internal latent image type silver halide emulsions, include hydrazines as described in U.S. Pat. Nos. 2,563,785, 2,588,982, etc.; hydrazides and hydrazones as described in U.S. Pat. No. 3,227,552; the heterocyclic quaternary salt compounds described in U.K. Pat. No. 1,283,835, Japanese Patent Application (OPI) No. 69,613/'77, and U.S. Pat. Nos. 3,615,615; 3,719,494; 3,734,738; 4,094,683; 4,115,122, etc.; sensitizing dyes having a substituent possessing a nucleating action in the dye molecule as described in U.S. Pat. No. 3,718,470; thiourea combined type acylhydrazine series compounds as described in U.S. Pat. Nos. 4,030,925, 4,031,127, 4,245,037, 4,255,511, 4,266,013, 4,276,364, U.K. Pat. No. 2,012,443, etc.; and acylhydrazine series compounds having combined therewith a heterocyclic group such as triazole, tetrazole, etc., or a thioamido ring as an adsorbing group, as described in U.S. Pat. Nos. 4,080,270 and 4,278,748, U.K. Pat. No. 2,011,391B, etc. However, other nucleating agents may also be used in the invention.

It is preferred that the amount of the nucleating agent which is used in this invention be an amount capable of providing a sufficient maximum density when the internal latent image type silver halide emulsion is developed by a surface developer. Since the amount of the nucleating agent depends upon various characteristics (sizes, conditions for chemical sensitization, etc.) of the silver halide emulsion for which the nucleating agent is applied, the chemical structure of the nucleating agent, and the development condition, the proper content of the nucleating agent can be varied within a wide range but in the case of adding the nucleating agent to a developer, the amount thereof is generally from about 1 mg to 5 g, and preferably from 5 mg to 0.5 g, per liter of developer. Also, in the case of incorporating the agent in the internal latent image type silver halide emulsion, the amount of generally about 0.01 mg to 5 g, preferably about 0.05 mg to 0.5 g per mole of silver in the silver halide emulsion. Furthermore, when the nucleating agent is incorporated in a hydrophilic colloid layer adjacent to a silver halide emulsion layer, the amount of the nucleating agent may be the same amount as described above to the amount of silver contained in the silver halide emulsion layer of the same area as that of the hydrophilic colloid layer.

The photographic silver halide emulsion of the photographic material in this invention may be spectrally sensitized to blue light having a comparatively long wavelenggh, green light, red light or infrared light using sensitizing dyes. Examples of such sensitizing dyes include cyanine dyes, merocyanine dyes, complex cyanine dyes, complex merocyanine dyes, holopolar cyanine dyes, styryl dyes, hemicyanine dyes, oxonole dyes, hemioxonole dyes, etc. These sensitizing dyes include the cyanine dyes and merocyanine dyes described, for example, in Japanese Patent Application (OPI) Nos. 40638/84; 40636/84 and 38739/84 (The term "OPI" as used herein refers to a "published unexamined Japanese Patent Application.")

Practical examples of the foregoing sensitizing dyes and other sensitizing dyes which are used in this invention are described, for example, in P. Glafkides, *Chimie Photographique,* 2nd edition, Chapters 35 to 41, published by Paul Montel, Paris (1957); F. M. Hamer, *The Cyanine Dyes and Related Compounds,* Interscience, New York (1964); and U.S. Pat. Nos. 2,503,776, 3,459,553, 3,177,210, etc.

The sensitizing dyes for internal latent image type silver halide emulsions which are used in this invention are used in the same concentration ranges as in the case of using them for ordinary negative type silver halide emulsions. In particular, it is preferred to use the sensitizing dyes in a dye concentration so as to not substantially reduce the intrinsic sensitivity of the silver halide emulsion. Generally, the amount of the sensitizing dye used is from about $1.0\times10^{-5}$ mole to about $5\times10^{-4}$ mole per mole of the silver halide, and preferably it is from $4\times10^{-5}$ to $2\times10^{-4}$ mole, per mole of the silver halide.

The photographic material which is used in this invention can contain color image-forming couplers as coloring materials. As the case may be, the photographic material can be developed by a developer containing a color image-forming coupler. Also, the photographic material may contain a developing agent such as a hydroxybenzene (e.g., a hydroquinone), an aminophenol, a 3-pyrazolidone, etc., or a precursor thereof in the silver halide emulsion layers, etc.

The photographic silver halide emulsions to which the present invention is applied can be used for transferring desired color images to an image-receiving layer after appropriate development by combining therewith dye image-providing compounds (coloring materials) for color diffusion transfer process capable of releasing diffusible dyes corresponding to the development of silver halide. Such coloring materials for color diffusion transfer process are described, for example, in U.S. Pat. Nos. 3,227,551; 3,227,554; 3,443,939; 3,443,940; 3,443,930; 3,443,943; 3,628,952; 3,844,785; 3,658,524; 3,698,897; 3,725,062; 3,728,113; 3,751,406; 3,929,760; 3,931,144; 3,932,381; 3,928,312; 4,013,633; 3,932,380; 3,954,476; 3,942,987; 4,013,635; 4,053,312; 4,199,354; 4,199,355; 4,135,929; 4,055,428; 4,268,625; 4,139,379; 4,139,389; 4,336,322; U.S. patent application Ser. No. 351,673; U.K. Pat. Nos. 840,731; 904,364 and 1,038,331; West German Patent Application (OLS) Nos. 1,930,215; 2,214,381; 2,228,361; 2,317,134; and 2,402,900; French Pat. No. 2,284,140; Japanese Patent Application (OPI) Nos. 46,730/'78; 130,122/'79; 33,926/'73; 650/'82; 4043/'82; 104,343/'76; 113,624/'76; 12,642/'81; 16,131/'81' 20,735/'82' 111,628/'74; 63,618/'76; 69,033/'78; and 130,927/'79; Japanese Patent Application No. 60.289/'83, etc.

Among the aforesaid coloring materials, the coloring materials or dye releasing redox materials which are originally non-diffusible but are cleaved by an oxidation reduction reaction with the oxidation product of a developing agent (or an electron donator) to release diffusible dyes (hereinafter referred to as DRR compounds) are preferably used and the DRR compounds having N-substituted sulfamoyl groups are particularly preferred. The coloring material is generally used in an amount of from about $1\times10^{-4}$ to about $1\times10^{-2}$ mole/m$^2$, and preferably from about $2\times10^{-4}$ to $2\times10^{-3}$ mole/m$^2$.

For the photographic materials which are used in this invention, various kinds of supports (plastic films, polymer-coated papers, synthetic papers, etc.) can be used. The silver halide emulsions may be coated on one surface or both surfaces of a support.

The photographic materials for use in this invention can further contain, in addition to the above-described additives, other known additives useful for the photographic silver halide emulsions, such as lubricatns, stabilizer, hardening agents, surface active agents, development accelerators, sensitizers, light absorbing dyes, stain preventing agents, plasticizers, etc.

In this invention, a compound releasing an iodine ion (e.g., potassium iodide, etc.) can be incorporated in the silver halide emulsions and further a desired image can be obtained using a developer containing an iodine ion.

For developing the photographic materials in this invention, various kinds of developing agents can be used. Examples include polyhydroxybenzenes such as hydroquinone, 2-chlorohydroquinone, 2-methylhydroquinone, catechol, pyrogallol, etc.; aminophenols such as p-aminophenol, N-methyl-p-aminophenol, 2,4-diaminophenol, etc.; 3-pyrazolidones such as 1-phenyl-3-pyrazolidone, 4,4-dimethyl-1-phenyl-3-pyrazolidone, 4,4-dihydroxymethyl-1-phenyl-3-pyrazolidone, 4-methyl-4-hydroxymethyl-1-phenyl-3-pyrazolidone, 4-methyl-4-hydroxymethyl-1-p-tolyl-3-pyrazolidone, etc.; and ascorbic acids. They can be used singly or as a combination thereof.

Also, for obtaining dye images by dye-forming couplers, aromatic primary amine developing agents, preferably p-phenylenediamine series developing agents can be used. Practical examples thereof include 4-amino-3-methyl-N,N-diethylaniline hydrochloride, N,N-diethyl-p-phenylenediamine, 3-methyl-4-amino-N-ethyl-N-β-(methanesulfonamide)ethylaniline, 3-methyl-4-amino-N-ethyl-N-(β-sulfoethyl)aniline, 3-ethoxy-4-amino-N-ethyl-N-(β-sulfoethyl)aniline, 4-amino-N-ethyl-N-(β-hydroxyethyl)aniline, etc. Such a developing agent may be incorporated in an alkaline processing composition (processing element) or in an appropriate layer of the photographic material.

In the case of using the DRR compounds in the photographic materials which are used in this invention, any silver halide developing agents (or electron donor) which can cross-oxidize these DRR compounds can be used, but 3-pyrazolidones are particularly preferred. Also, the developer may further contain preservatives such as sodium sulfite, potassium sulfite, ascorbic acid, a reductone (e.g., piperidinohexose reductone), etc.

The photographic materials which are used in this invention can provide direct positive images by developing using a surface developer. The development step by the surface developer is substantially induced by the latent images or fogging nuclei existing on the surfaces of silver halide grains. It is preferred that the developer does not contain a silver halide dissolving agent, but the developer may contain a silver halide dissolving agent (e.g., a sulfite) to some extent if an internal latent image does not substantially contribute before the development by the surface development center of the silver halide grains is completed.

The developer may further contain sodium hydroxide, potassium hydroxide, sodium carbonate, potassium carbonate, sodium tertiary phosphate, sodium metaborate, etc., as an alkali agent or a buffer. The content of these additives is selected so that the pH of the developer becomes from 10 to 14, and preferably from 12 to 14. Also, it is advantageous that the developer contains a color development accelerator such as benzyl alcohol or a compound usually used as antifoggant, such as benzimidazole such as 5-nitrobenzimidazole, etc., or a benztriazole such as benztriazole, 5-methyl-benztriazole, etc., as a chemical for further lowering the minimum density (fog) of the direct positive images.

When the present invention is applied to a diffusion transfer photographic material it is preferred to process the photographic material with a viscous developer. The viscous developer is a liquid composition containing processing components necessary for developing the silver halide emulsions and forming diffusion transfer dye images. The solvent is mainly water, although the developer may contain other hydrophilic solvent such as methanol, methyl cellosolve, etc. The processing composition contains an alkali in an amount sufficient for maintaining a pH necessary for development of silver halide emulsion layers and neutralizing acids (e.g., a hydrohalogenic acid such as hydrobromic acid, etc., and a carboxylic acid such as acetic acid, etc.) formed during the various steps of the development and the formation of dye images. Examples of the alkali are lithium hydroxide, sodium hydroxide, potassium hydroxide, a calcium hydroxide, sodium carbonate, sodium tertiary phosphate, tetramethylammonium hydroxide, an alkali metal salt (or alkaline earth metal salt) of diethylamine, etc., and an amine. It is preferred to contain an alkali metal hydroxide in a concentration providing a pH of higher than about 12 (preferably higher than 13) at room temperature.

The processing composition contains more preferably a hydrophilic polymer such as polyvinyl alcohol having a high molecular weight, hydroxyethyl cellulose, sodium carboxymethyl cellulose, etc. These polymers are profitably used for providing a viscosity of higher than 1 poise, and preferably from about 500 to 1,000 poises, at room temperature, to the processing composition.

It is advantageous particularly in the case of a monosheet film unit that the processing composition contains a light-absorbing material such as carbon black or a pH indicating dye as a light-shielding agent for preventing the silver halide emulsion layers from being fogged by external light during or after the processing, and also a desensitizer as described in U.S. Pat. No. 3,579,333. The processing composition may further contain a development restrainer such as benzotriazole, etc.

It is preferred that the above-described processing composition is packed in a rupturable container, as described, e.g., in U.S. Pat. Nos. 2,543,181; 2,643,886; 2,653,732; 2,723,051; 3,056,491; 3,056,492; 3,152,515, etc.

In the case of using the photographic materials for diffusion transfer photographic process in this invention, it is preferred that the photographic material be in the form of a film unit. A photographic film unit, that is, a film unit in which the development can be performed by passing the film unit through a pair of juxtaposed pressure-applying members, is fundamentally composed of the following three elements:

(1) A photosensitive element (containing the rereversal restrainer according to the present invention), (2) image-receiving element, and (3) processing element (a processing member containing in a container which is rupturable under pressure and can release and spreads a processing liquid in the inside of the film unit).

A preferred embodiment of the photographic film unit is the type wherein the aforesaid element are laminated in a unitary form as described in U.K. Pat. No. 1,330,524. In the embodiment, an image-receiving layer and a photosensitive element composed of a substantially opaque light-reflecting layer (e.g., a $TiO_2$-containing layer), a light-shielding layer (e.g., a carbon black-containing layer), and one or plural silver halide emulsion layers having associated therewith DRR compounds are coated on a transparent support and a transparent cover sheet is superposed thereon in a face-to-face relation. A rupturable container containing an alkaline processing composition containing an opacifying agent (e.g., carbon black) is disposed between the uppermost layer of the aforesaid photosensitive element and the transparent cover sheet. The film unit is imagewise exposed through the transparent cover sheet, the container is ruptured by means of pressure-applying applying members during withdrawal of the film unit from a camera and, thus, the processing composition (containing an opacifying agent) is uniformly spread overall between the protective layer (the uppermost layer) of the photosensitive element and the cover sheet. Thus, the development proceeds in a light-shielded state. It is preferred that the cover sheet is one prepared by coating, in succession, a neutralizing layer, and, if necessary, a neutralization speed controlling layer (timing layer) on a support.

Also, other useful integrating unitary embodiments capable of using DRR compounds or diffusible dye releasing couplers are described in U.S. Pat. Nos. 3,415,644; 3,415,645; 3,415,646; 3,674,687; 3,635,707; 3,594,164; and 3,993,486, U.K. Pat. No. 1,330,524, European Pat. No. 53,328, etc.

Moreover, the form of the film unit may be a so-called peel apart type wherein the photosensitive element is peeled apart from the image-receiving element after processing.

The invention is described further by examples using the re-reversal restrainers according to this invention, but the invention is not limited to these embodiments of the invention.

EXAMPLE 1

A color direct positive diffusion transfer photosensitive sheet (1) was prepared by coating, in succession, the following layers (1) to (6) on a transparent polyethylene terephthalate film support:

(1) A mordanting layer (image-receiving layer) containing 3.0 g/m$^2$ of the following copolymer and 3.0 g/m$^2$ of gelatin.

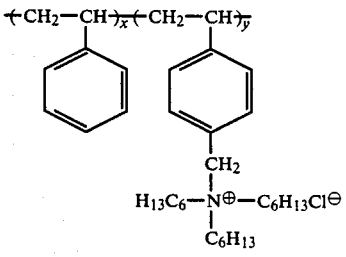

-continued x/y = 50/50

(2) A white light-reflecting layer containing 18.0 g/m$^2$ of titanium oxide and 2.0 g/m$^2$ of gelatin.

(3) A black light-shielding layer containing 2.0 g/m$^2$ of carbon black and 1.0 g/m$^2$ of gelatin.

(4) A magenta color material layer containing 0.21 g/m$^2$ of the magenta DRR compound having the structure I shown below, 0.11 g/m$^2$ of the magental DRR compound having the structure II shown below, 0.08 g/m$^2$ of tricyclohexyl phosphate, 0.01 g/m$^2$ of 2,5-di-tert-pentadecylhydroquinone, and 0.9 g/m$^2$ of gelatin.

Structure I:

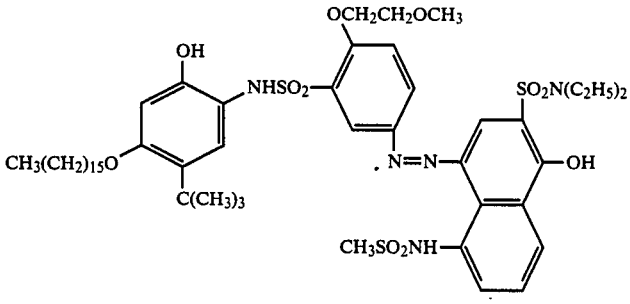

Structure II:

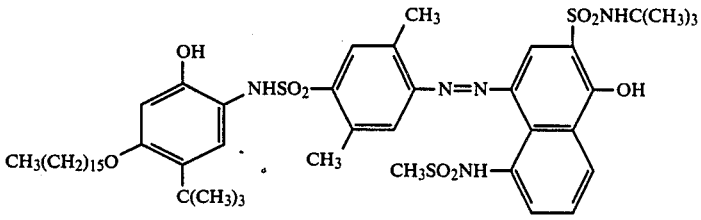

(5) A green-sensitive photosensitive direct positive silver halide emulsion layer containing a dye-sensitized octahedral internal latent image type silver bromoiodide (containing 2 mole% iodine) having a mean grain side length of 1.5 μm (1.40 g/m$^2$ as an amount of silver), 0.01 g/m$^2$ of sodium 5-n-pentadecylhydroquinone-2-sulfonate, and 0.0035 mg/m$^2$ of nucleating agent I having the following structural formula.

Nucleating agent I

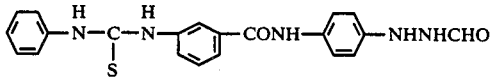

(6) A protective layer containing 0.20 g/m$^2$ of the ultraviolet absorbent having the structure shown below, 0.02 g/m$^2$ of triacroyltriazine as a hardening agent, and 0.3 g/m$^2$ of gelatin.

Ultraviolet absorbent:

-continued

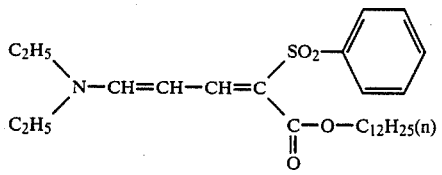

Also, photosensitive sheets (2) to (26) were prepared in the same manner as described above, except that each of the compounds shown in Table 1 was incorporated in the silver halide emulsion layer (5) according to the method of this invention.

Each of the above-described color positive photosensitive sheets (1) to (26) was exposed and developed by combining with the following processing liquid and coversheet.

| Processing Liquid Composition: | |
|---|---|
| 1-p-Tolyl-4-methyl-4-hydroxy-methyl-3-pyrazolidone | 8.0 g |
| Tert-butylhydroquinone | 0.1 g |
| 5-Methylbenztriazole | 2.5 g |
| Benzyl Alcohol | 1.5 ml |
| Sodium Sulfite (Anhydrous) | 1.5 g |
| Zinc Nitrate (6-Hydrate) | 0.4 g |
| Carboxymethyl Cellulose Na Salt | 61 g |
| Carbon Black | 410 g |
| Potassium Hydroxide | 56 g |
| Water | 260 ml |
| | (pH about 13.7) |

Cover Sheet:

The cover sheet was prepared by coating 15 g/m$^2$ of polyacrylic acid (an aqueous 10 wt.% solution having a viscosity of about 1,000 c.p.) as an acid polymer layer (neutralizing layer) on a polyethylene terephthalate film support and then coating thereon 3.8 g/m$^2$ of acetyl cellulose (forming 39.4 g of acetyl group by the hydrolysis of 100 g thereof) and 0.2 g/m$^2$ of a copolymer of styrene and maleic anhydride (styrene:maleic anhydride=about 60:40 by mole ratio, molecula weight of about 50,000) as a neutralizing timing layer.

Light Exposure and Processing Step:

The above-described cover sheet was superposed on each of the above-described photosensitive sheets (1) to (26) and a rupturable containing packed with 0.8 g of the above-described processing light was disposed at the ends of the sheets. The film unit thus obtained was flash-exposed for 1/10,000 sec. through a continuous wedge from the cover sheet side of the film unit under a light amount of maximum 107,000 cd. m. s. by a xenon light source, and then the processing liquid was quickly spread between both sheets at a uniform liquid thickness of 100 μm using a press-applying rollers. The light exposure and the spreading processing were performed at room temperature (about 25° C.). After one hour since the processing, the color density of the magenta image formed on the image-receiving layer was measured through the transparent support of the photosensitive sheet by means of a Macbeth reflection densitometer.

The relative sensitivities of the re-reversal negative images formed at the high-illuminance sides under the light exposure are shown in Table 1 with the sensitivity of photosensitive sheet (1) being defined as 100. In addition, the standard sensitivity of the re-reversal negative image provided by the comparison photosensitive sheet (1) containing no re-reversal restrainer was about 80 under the measurement condition described hereinbefore.

As shown in the results of Table 1, it can be clearly seen from the reduction of the negative image sensitivity that by adding the cyanine dyes or merocyanine dyes of formula (I) to (IX) according to this invention, the formation of re-reversal negative images in the photosensitive materials is effectively restrained.

TABLE 1

| | Negative image restraining effect in color direct positive photosensitive material | | |
|---|---|---|---|
| Photosensitive Sheet No. | Added Compound | Amount (mg/m$^2$) | Relative sensitivity of negative images |
| 1* | none | — | 100 |
| 2 | I - 2 | 0.17 | 85 |
| 3 | I - 5 | " | 87 |
| 4 | I - 7 | " | 50 |
| 5 | II - 3 | " | 85 |
| 6 | III - 1 | " | 87 |
| 7 | III - 7 | " | 85 |
| 8 | IV - 2 | " | 83 |
| 9 | IV - 3 | " | 83 |
| 10 | V - 7 | " | 85 |
| 11 | V - 8 | " | 87 |
| 12 | VI - 5 | " | 85 |
| 13 | VII - 13 | " | 95 |
| 14 | VIII - 2 | " | 85 |
| 15 | IXa - 8 | 0.33 | 63 |
| 16 | IXa - 13 | " | 43 |
| 17 | IXa - 29 | " | 66 |
| 18 | IXa - 30 | " | 59 |
| 19 | IXa - 31 | " | 62 |
| 20 | IXa - 33 | " | 74 |
| 21 | IXa - 34 | " | 56 |
| 22 | IXa - 41 | " | 55 |
| 23 | IXb - 13 | " | 71 |
| 24 | IXb - 19 | " | 8 |
| 25 | IXb - 36 | " | 49 |
| 26 | IXb - 44 | " | 63 |

1*: Comparison

EXAMPLE 2

A multilayer color diffusion transfer photosensitive sheet (A) was prepared by coating, in succession, the following layers on a transparent polyethylene terephthalate film support:

(1) A mordanting layer as in Example 1.

(2) A white light-reflection layer as in Example 1.

(3) A black light-shielding layer as in Example 1.

(4) A layer containing 0.44 g/m$^2$ of the cyan DRR compound having the structure shown below, 0.09 g/m$^2$ of tricyclohexyl phosphate, 0.008 g/m$^2$ of 2,5-di-tert-pentadecylhydroquinone, and 0.8 g/m$^2$ of gelatin.

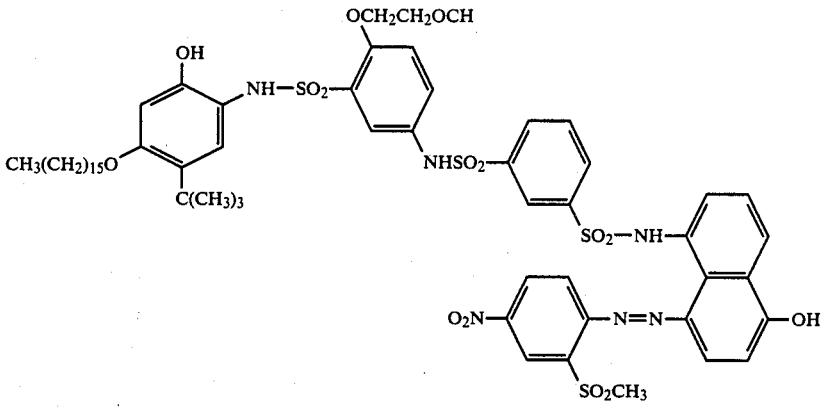

(5) A reflecting layer containing 8.5 g/m$^2$ of titanium oxide and 0.1 g/m$^2$ of gelatin.

(6) A red-sensitive photosensitive direct positive silver halide emulsion layer containing dye-sensitized octahedral internal latent image type silver bromide having a mean grain side length of 1.0 μm (0.55 g/m$^2$ as the amount of silver), 0.4 g/m$^2$ of gelatin, 0.03 g/m$^2$ of sodium 5-n-pentadecylhydroquinone-2-sulfonate, and 0.010 mg/m$^2$ of nucleating agent I.

(7) A red-sensitive photosensitive direct positive silver halide emulsion layer containing a dye-sensitized octahedral internal latent image type silver bromide having a mean grain side length of 1.7 μm (1.25 g/m$^2$ as the amount of silver), 0.6 g/m$^2$ of gelatin, 0.06 g/m$^2$ of sodium 5-n-pentadecylhydroquinone, and 0.0020 mg/$^2$ of nucleating agent II having the structure shown below.

Nucleating Agent II:

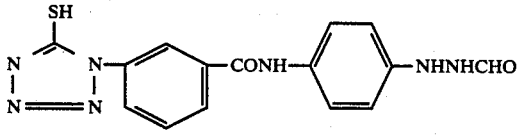

(8) An interlayer containing 0.43 g/m$^2$ of 2,5-di-tert-pentadecylhydroquinone, 0.1 g/m$^2$ of trihexyl phosphate, and 0.4 g/m$^2$ of gelatin.

(9) A magenta coloring material layer as in Example 1.

(10) A titanium oxide-containing reflecting layer as in Example 1.

(11) A green-sensitive photosensitive direct positive silver halide emulsion layer containing dye-sensitized octahedral internal latent image type silver bromide having a mean grain side length of 1.0 μm (0.38 g/m$^2$ as the amount of silver), 0.3 g/m$^2$ of gelatin, 0.06 g/m$^2$ of sodium 5-n-pentadecylhydroquinone-2-sulfonate, and 0.0015 mg/m$^2$ of nucleating agent I.

(12) A green-sensitive photosensitive direct positive silver halide emulsion layer containing dye-sensitized octahedral internal latent image type silver bromide having a mean grain side length of 1.7 μm (1.18 g/m$^2$ as the amount of silver), 0.6 g/m$^2$ of gelatin, 0.11 g/m$^2$ of soium 5-n-pentadecylhydroquinone, and 0.0010 mg/m$^2$ of nucleating agent II.

(13) An interlayer same as the layer (8).

(14) A layer containing 0.53 g/m$^2$ of the yellow DRR compound having the structure shown below, 0.13 g/m$^2$ of tricyclohexyl phosphate, 0.014 g of 2,5-d-tert-pentadecylhydroquinone, and 0.7 g/m$^2$ of gelatin.

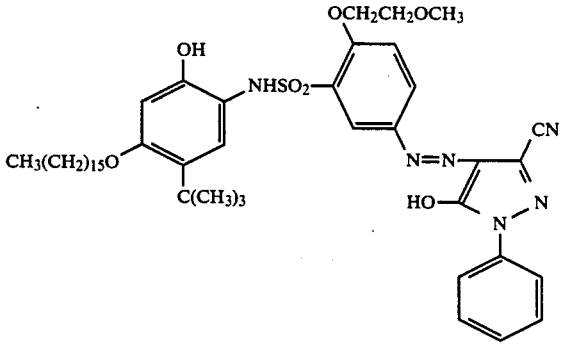

(15) A titanium oxide-containing reflecting layer as the layer (5).

(16) A blue-sensitive photosensitive direct positive silver halide emulsion layer containing dye-sensitized octahedral internal latent image type silver bromide having a mean grain side length of 1.0 μm (0.37 g/m$^2$ as the amount of silver), 0.2 g/m$^2$ of gelatin, 0.03 g/m$^2$ of sodium 5-n-pentadecylhydroquinone-2-sulfonate, and 0.0080 mg/m$^2$ of nucleating agent I.

(17) A blue-sensitive photosensitive direct positive silver halide emulsion layer containing dye-sensitized octahedral internal latent image type silver bromide having a mean grain side length of 1.7 μm (1.25 g/m$^2$ as the amount of silver), 0.6 g/m$^2$ of gelatin, 0.04 g/m$^2$ of sodium 5-pentadecylhydroquinone-n-sulfonate, and 0.0040 mg/m$^2$ of nucleating agent II.

(18) A protective layer which is the same as the layer (6) of Example 1.

Also, multilayer color photosensitive sheets (B) to (E) were prepared by following the same procedure as above, except that each of the illustrated compounds shown in Table 2 were added as re-reversal restrainers to each of the red-sensitive emulsion layer (7), the green-sensitive emulsion layer (12), and the blue-sensitive emulsion layer (17), as shown in Table 2.

Each of the above-described photosensitive sheets was combined with the processing liquid and the cover sheet as in Example 1, and after flash-exposing for 1/10,000 sec., the processing liquid was spread between both the sheets to conduct development. Each of the yellow, magenta, and cyan color densities of the re-reversal negative images formed at the high-illuminance portions was measured by means of a Macbeth reflection densitometer and relative sensitivity of negative image is shown in Table 2. In addition, the standard sensitivity of the negative image provided by each photosensitive layer (BL, GL and RL) of the comparison photosensitive sheet (A), containing no re-reversal restrainer was set at 100 under the measurement condition described in hereinabove.

TABLE 2

| Photosensitive Sheet No. | Negative image restraining effect in multilayer color direct positive photosensitive sheet: Emulsion Layer | Compound | Amount mg/m² | Relative Sensitivity of Negative Image |
|---|---|---|---|---|
| A (Comparative) | BL | none | — | 100 |
| | GL | " | — | 100 |
| | RL | " | — | 100 |
| B | BL | IXa-29 | 0.32 | 80 |
| | GL | IXa-19 | 0.29 | 23 |
| | RL | IXb-19 | 0.17 | 47 |
| | | IXa-29 | 0.17 | |
| C | BL | IXa-29 | 0.32 | 80 |
| | GL | IXa-34 | 0.16 | 56 |
| | | IXb-19 | 0.16 | |
| | RL | IXa-34 | 0.17 | 50 |
| | | IXb-19 | 0.17 | |
| D | BL | IXa-8 | 0.26 | 55 |
| | GL | IV-2 | 0.20 | 80 |
| | RL | I-7 | 0.20 | 50 |
| E | BL | IXa-31 | 0.26 | 80 |
| | GL | IXa-41 | 0.32 | 56 |
| | RL | IV-2 | 0.20 | 80 |

BL: Blue-sensitive emulsion layer
GL: Green-sensitive emulsion layer
RL: Red-sensitive emulsion layer As is clear from the results shown in Table 2, it can be seen that by adding one or two kinds of appropriate re-reversal restrainers to the emulsion layers of a color direct positive photosensitive sheets according to this invention, the formation of the re-reversal negative image in each emulsion layer is effectively restrained, and the photographic quality of the photosensitive sheet is substantially improved.

While the invention has been described in detail and with reference to specific embodiments thereof, it will be apparent to one skilled in the art that various changes and modifications can be made therein without departing from the spirit and scope thereof.

What is claimed is:

1. A restraining method for restraining the formation of a re-reversal negative image comprising incorporating a cyanine dye or a merocyanine dye which is electron donative and adsorbable on silver halide in at least one hydrophilic colloid layer of an internal latent image type direct positive silver halide photographic material as a re-reversal restrainer, wherein said direct silver halide photographic material contains at least one internal latent image type direct positive silver halide photographic emulsion layer providing a maximum sensitivity of the high illuminance re-reversal negative image of the silver halide emulsion layer of higher than 30 wherein the sensitivity is as defined below:

Coating Conditions:

a black and white internal latent image type direct positive photographic material containing no said restrainer is prepared by uniformly coating the silver halide emulsion on one surface of a transparent support at a silver coverage of 5.0 g/m², and the nucleating agent having the structural formula:

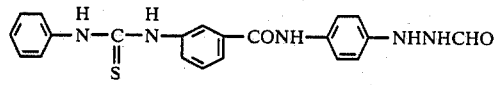

is added to the silver halide emulsion in an amount such as the maximum density of the direct positive image obtained after development is higher than 1.0;

Exposure Condition:

the silver halide emulsion layer side of the photographic material is exposed for 1/10,000 seconds by white light of a color temperature of 4,800° K. using a xenon lamp as a light source;

Processing Condition:

after developing using a surface developer composed of 0.06 wt% 1-phenyl-3-pyrazolidone, 1 wt% of hydroquinone, 3 wt% sodium sulfite, 4 wt% sodium tertiary phosphate, and 1.1 wt% sodium hydroxide at 20° C. for 10 minutes, fixing and washing are performed;

Negative Sensitivity Indication:

shown by 100 times the reciprocal of the exposure amount (cd. m. s.) at the density point of (maximum density + minimum density) × ½ of the negative image.

2. A restraining method as in claim 1, wherein said internal latent image type direct positive silver halide photographic emulsion layer has a maximum negative sensitivity of higher than 50.

3. A restraining method as in claim 1, wherein the content of the re-reversal restrainer in the internal latent image type direct positive silver halide photographic material is in the range of from $1\times10^{-6}$ mole to $5\times10^{-3}$ mole per mole of the silver halide in the silver halide emulsion layer.

4. A restraining method as in claim 1, wherein the oxidation potential of the re-reversal restrainer is in the range of from +0.3 to 0.9 volt with respect to a saturated calomel standard electrode (SCE).

5. A restraining method as in claim 1, wherein the photosensitive colloid layer containing the re-reversal restrainer is an internal latent image type direct positive silver halide emulsion layer.

6. A restraining method as in claim 1, wherein the internal latent image type direct positive silver halide photographic material has at least one silver halide emulsion layer on a support and at least one of said silver halide emulsion layers contains at least one kind of silver halide grains groups having a mean grain side length longer than 0.7 μm.

7. A restraining method as in claim 6, wherein the internal latent image type direct positive silver halide photographic material has at least one internal latent image type direct positive silver halde emulsion layer spectrally sensitized by a spectral sensitizing dye on a support and the oxidation potential of the re-reversal restrainer used is electrochemically more negative than the oxidation potential of the spectral sensitizing dye.

8. A restraining method as in claim 5, wherein the content of the re-reversal restrainer in the internally image type direct positive silver halide emulsion layer is in the range of from $1\times10^{-6}$ mole to $5\times10^{-3}$ mole per mole of silver halide in the silver halide emulsion layer, and the oxidation potential of the re-reversal restrainer is in the range of from +0.3 to 0.9 volt with respect to a saturated calomel standard electrode (SCE).

9. A restraining method as in claim 1, wherein the content of re-reversal restrainer in the internally image type direct positive silver halide emulsion layer is in the range of from $2\times10^{-5}$ mole to $1\times10^{-3}$ mole per mole of silver halide in the silver halide emulsion layer.

10. A restraining method as in claim 1, wherein the oxidation potential of the re-reversal restrainer is in the range of from +0.4 to 0.8 volt with respect to a saturated calomel standard electrode (SCE).

11. A restraining method as in claim 1, wherein the cyanine dye or merocyanine dye which is electron donative and adsorbable on silver halide is selected from compound represented by any of of formulae (I), (II), (III), (IV), (V), (VI), (VII), (VIII), and (IX)

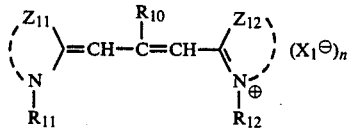

(I)

wherein $Z_{11}$ and $Z_{12}$ each represents a nonmetallic atomic group completing a thiazole nucleus, a thiazoline nucleus, benzothiazole nucleus, a naphthothiazole nucleus, benzoselenazole nucleus, or a naphthoselenazole nucleus; $R_{11}$ and $R_{12}$ each represents an alkyl group; $R_{10}$ represents a hydrogen atom, an alkyl group, or an aryl group; $X_1\ominus$ represents an acid anion; and n represents 0 or 1;

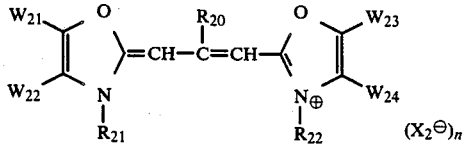

(II)

wherein $W_{21}$, $W_{22}$, $W_{23}$, and $W_{24}$ each represents a hydrogen atom, an alkyl group, or an aryl group; or said $W_{21}$ and $W_{22}$ or said $W_{23}$ and $W_{24}$ combine with each other to form a substituted or unsubstituted benzene ring or a substituted or unsubstituted naphthalene ring; $R_{21}$ and $R_{22}$ each represents an alkyl group; $R_{20}$ represents a hydrogen atom, an alkyl group or an aryl group; $X_2\ominus$ represents an acid anion; and n represents 0 or 1;

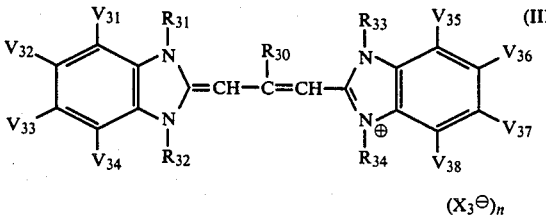

(III)

wherein $V_{31}$ to $V_{38}$ each represents a hydrogen atom, a halogen atom, a trifluoromethyl group, a cyano group, a carboxy group, an alkoxycarbonyl group, a sulfamoyl group, a sulfonyl group, or a carbamoyl group; or said $V_{31}$ and $V_{32}$, said $V_{32}$ and $V_{33}$, said $V_{33}$ and $V_{34}$, said $V_{35}$ and $V_{36}$, said $V_{36}$ and $V_{37}$ or said $V_{37}$ and $V_{38}$ combine with each other to form a carbon ring; $R_{31}$ to $R_{34}$ each represents an alkyl group; $R_{30}$ represents a hydrogen atom, an alkyl group or an aryl group; $X_3\ominus$ represents an acid anion; and n represents 0 or 1;

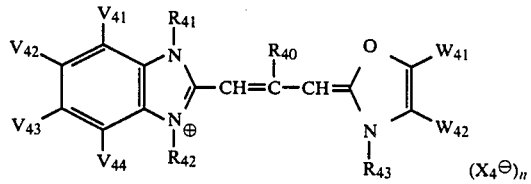

(IV)

wherein $V_{41}$ to $V_{44}$, $R_{41}$ and $R_{42}$ have the same meanings as $V_{31}$ to $V_{34}$, $R_{31}$ and $R_{32}$, respectively, defined for formula (III); $W_{41}$, $W_{42}$, and $R_{43}$ have the same meanings as $W_{21}$, $W_{22}$, and $R_{21}$, respectively, in formula (II); $R_{40}$ represents a hydrogen atom, an alkyl group, or an aryl group; $X_4\ominus$ represents an acid anion; and n represents 0 or 1;

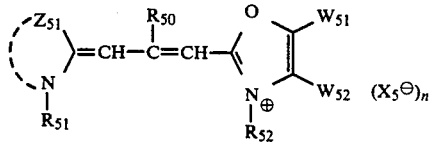

(V)

wherein $Z_{51}$, $R_{50}$, and $R_{51}$ have the same meanings as $Z_{11}$, $R_{10}$, and $R_{11}$, respectively, in formula (I); $W_{51}$, $W_{52}$, and $R_{52}$ have the same meanings as $W_{21}$, $W_{22}$, and $R_{21}$, respectively, in formula (II); $X_5\ominus$ represents an acid anion; and n represents 0 or 1;

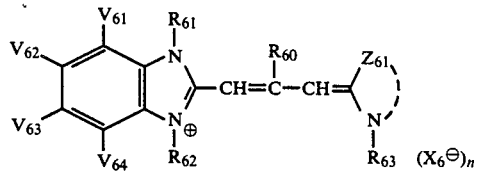

(VI)

wherein $V_{61}$ to $V_{64}$, $R_{61}$ and $R_{62}$ have the same meanings as $V_{31}$ to $V_{34}$, $R_{31}$ and $R_{32}$, respectively, in formula (III); $Z_{61}$, $R_{63}$, and $R_{60}$ have the same meanings as $Z_{11}$, $R_{12}$, and $R_{10}$, respectively, in formula (I); said $Z_{61}$ further includes a nonmetallic atomic group completing an indoline nucleus; $X_6\ominus$ represents an acid anion; and n represents 0 or 1;

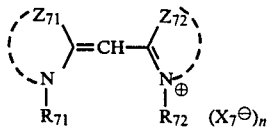

(VII)

wherein $Z_{71}$ and $Z_{72}$ each represents a nonmetallic atomic group forming a benzoxazole nucleus, a benzothiazole nucleus, a benzoselenazole nucleus, a naphthoxazole nucleus, a naphthothiazole nucleus, naphthoselenazole nucleus, a thiazole nucleus, a thiazoline nucleus, an oxazole nucleus, a selenazole nucleus, a selenazoline nucleus, a pyridine nucleus, or a quinoline nucleus; $R_{71}$ and $R_{72}$ each represents an alkyl group; $X_7\ominus$ repreents an acid anion; and n represents 0 or 1;

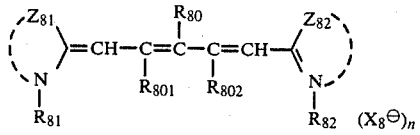

(VIII)

wherein $Z_{81}$ and $Z_{82}$ each represents a nonmetallic atomic group completing a pyridine nucleus, a quinoline nucleus, a benzothiazole nucleus, a naphthothiazole nucleus, a benzoxazole nucleus, a benzoselenazole nucleus, a naphthoxazole nucleus, a naphthoselenazole nucleus, a thiazole nucleus, or a thiazoline nucleus; $R_{81}$ and $R_{82}$ each represents an alkyl group; $R_{80}$, $R_{801}$, and $R_{802}$ each represents a hydrogen atom an alkyl group, or a halogen atom; or said $R_{801}$ and $R_{802}$ combine with each other to form a ring; $X_8^{\ominus}$ represents an acid anion; and n represents 0 or 1;

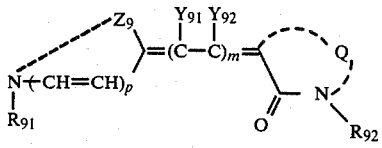

(IX)

wherein $Z_9$ represents a nonmetallic atomic group completing a thiazoline nucleus, a thizolizolidine nucleus, a selenazolidine nucleus, a selenazolidine nucleus, pyrrolidine nucleus, a dihydropyridine nucleus, an oxazoline nucleus, an oxazolidine nucleus, an imidazoline nucleus, an indoline nucleus, a tetrazoline nucleus, a benzothiazoline nucleus, a benzoselenazoline nucleus, a benzimidazoline nucleus, a benzoxazoline nucleus, a naphthothiazoline nucleus, a naphthoselenazoline nucleus, a naphthoxazoline nucleus, a naphthoimidazoline nucleus, or a dihydroquinoline nucleus; Q represents a nonmetallic atomic group necessary for completing a rhodanine nucleus, 2-thiooxazoline-2,4-dione nucleus, 2-thioselenazoline-2,4-dione nucleus, a 2-thiohydantoin nucleus, a barbituric acid nucleus or 2-thiobarbituric acid nucleus; $R_{91}$ and $R_{92}$ each represents a hydrogen atom, an alkyl group, or an aryl group; $Y_{91}$ and $Y_{92}$ each represents a hydrogen atom, an alkyl group, or an aryl group; m represents 0, 1 or 2; and p represents 0 or 1.

12. A restraining method as in claim 11, wherein the content of the re-reversal restrainer in the internal latent image type direct positive silver halide photographic material is in the range of from $1\times10^{-6}$ mole to $5\times10^{-3}$ mole per mole of the silver halide in silver halide emulsion layer.

13. A restraining method as in claim 11, wherein the oxidation potential of the re-reversal restrainer is in the range of from +0.3 to 0.9 volt with respect to a saturated calomel standard electrode (SCE).

14. A restraining method as in claim 11, wherein the hydrophilic colloid layer containing the re-reversal restrainer is an internal latent image type direct positive silver halide emulsion layer.

15. A restraining method as in claim 11, wherein the internal latent image type direct positive silver halide photographic material has at least one silver halide emulsion layer on a support and at lest one of said silver halide emulsion layers contains at least one kind of silver halide grains groups having a mean grain side length longer than 0.7 μm.

16. A restraining method as in claim 11, wherein the internal latent image type direct positive silver halide photographic material has at least one internal latent image type direct positive silver halide emulsion layer spectrally sensitized by a spectral sensitizing dye on a support and the oxidation potential of the re-reversal restrainer used is electrochemically more negative than the oxidation potential of the spectral sensitizing dye.

17. A restraining method as in claim 11, wherein the content of the re-reversal restrainer in the internally image type direct positive silver halide emulsion layer is in the range of from $1\times10^{-6}$ mole to $5\times10^{-3}$ mole per mole of silver halide in the silver halide emulsion layer, and the oxidation potential of the re-reversal restrainer is in the range of from +0.3 to 0.9 volt with respect to a saturated calomel standard electrode (SCE).

18. A restraining method as in claim 11, wherein the content of the re-reversal restrainer in the internal image type direct positive silver halide emulsion layer is in the range of from $2\times10^{-5}$ mole to $1\times10^{-3}$ mole per mole of silver halide in the silver halide emulsion layer.

19. A restraining method as in claim 11, wherein the re-reversal restrainer is in the range of from +0.4 to 0.8 volt with respect to a saturated calomel standard electrode (SCE).

20. A restraining method as in claim 1, wherein the re-reversal restrainer is incorporated to a hydrophilic colloid layer which is adjacent to an internal latent image type direct positive silver halide photographic emulsion layer.

21. A restraining method as in claim 1, wherein the cyanine dye or merocyanine dye which is electron donative and adsorbable on silver halide is selected from a compound represented by any of formula (I) and (II)

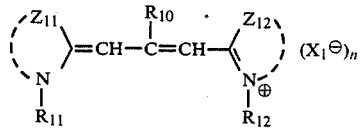

(I)

wherein $Z_{11}$ and $Z_{12}$ each represents a nonmetallic atomic group completing a thiazole nucleus, a thiazoline nucleus, benzothiazole nucleus, a naphthothiazole nucleus, benzoselenazole nucleus, or a naphthaselenazole nucleus; $R_{11}$ and $R_{12}$ each represents an alkyl group, $R_{10}$ represents a hydrogen atom, an alkyl group, or an aryl group; $X_1^{\ominus}$ represents an acid anion; and n represents 0 or 1;

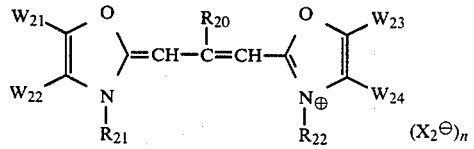

(II)

wherein $W_{21}$, $W_{22}$, $W_{23}$, and $W_{24}$ each represents a hydrogen atom, an alkyl group, or an aryl group; or said $W_{21}$ and $W_{22}$ or said $W_{23}$ and $W_{24}$ combine with each other to form a substituted or unsubstituted benzene ring or a substituted or unsubstituted naphthalene ring; $R_{21}$ and $R_{22}$ each represents an alkyl group; $R_{20}$ represents a hydrogen atom, an alkyl group or an aryl group; $X_2^{\ominus}$ represents an acid anion; and n represents 0 or 1.

22. A restraining method as claimed in claim 1, wherein the silver halide in the silver halide emulsion is selected from silver bromide, silver iodide, silver chlorobromide, silver bromoiodide, and silver chlorobromo-iodide.

23. A restraining method as claimed in claim 1, wherein the silver halide emulsion is composed of at least 50 mol % silver bromide.

24. A restraining method as claimed in claim 23, wherein the silver halide emulsion is a silver bromoiodide emulsion.

25. A restraining method as claimed in claim 24, wherein the silver bromoiodide emulsion contains from zero to less than about 10 mol % silver iodide.

26. A restraining method as claimed in claim 11, wherein the cyanine dye or merocyanine dye which is electron donative and adsorbable on silver halide is selected from a compound represented by any one of formulae (III), (IV), (V), (VI), and, (VIII).

27. A photographic element comprising (a) at least one hydrophilic colloid layer of an internal latent image type direct positive silver halide photographic material and (b) a cyanine dye or a merocycanine dye which is electron donative and adsorbable on silver halide as a reversal restrainer incorporated in the hydrophilic colloid layer, and wherein said direct positive silver halide photographic material contains at least one internal latent image type direct positive silver halide photographic emulsion layer providing a maximum sensitivity of the high illuminance re-reversal negative image of the silver halide emulsion layer of higher than 30 wherein the sensitivity is as defined below:

Coating Condition:

black and white internal latent image type direct positive photographic material containing no said restrainer is prepared by uniformly coating the silver halide emulsion on one surface of a transparent support at a silver coverage of 5.0 g/m$^2$, and a nucleating agent having the structural formula:

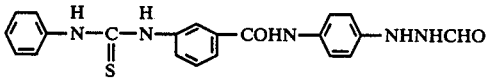

is added to the silver halide emulsion in an amount such that the maximum density of the direct positive image obtained after development is higher than 1.0;

Exposure Condition:

the silver halide emulsion layer side of the photographic material is exposed for 1/10,00 seconds by white light of a color temperature of 4,800° K. using a xenon lamp as a light source;

Processing Condition:

after developing using a surface developer composed of 0.06 wt% 1-phenyl-3-pyrazolidone, 1 wt% of hydroquinone, 3 wt% sodium sulfite, 4 wt% sodium tertiary phosphate, and 1.1 wt% sodium hydroxide at 20° C. for 10 minutes, fixing and washing are performed:

Negative Sensitivity Indication:

shown by 100 times the reciprocal of the exposure amount (cd. m.s.) at the density point of (maximum density + minimum density) $\times \frac{1}{2}$ of the negative image.

28. The photographic material as in claim 27, wherein the content of the re-reversal restrainer in the internal latent image type direct positive silver halide photographic material is in the range of from $1\times10^{-6}$ mole to $5\times10^{-3}$ mole per mole of the silver halide in the silver halide emulsion layer.

29. The photographic material as in claim 1, wherein the cyanine dye or merocyanine dye which is electron donative and adsorbable on silver halide is selected from a compound represented by any of formula (I), (II), (III), (IV), (V), (VI), (VII), (VIII), and (IX)

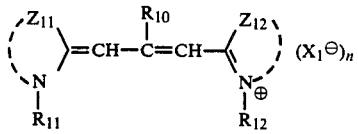

(I)

wherein $Z_{11}$ and $Z_{12}$ each represents a non-metallic atomic group completing a thiazole nucleus, a thiazoline nucleus, benzothiazole nucleus, a naphthothiazole nucleus, benzoselenazole nucleus, or a naphthoselenazole nucleus; $R_{11}$ and $R_{12}$ each represents an alkyl group; $R_{10}$ represents a hydrogen atom, an alkyl group, or an aryl group; $X_1\ominus$ represents an acid anion; and n represents 0 to 1;

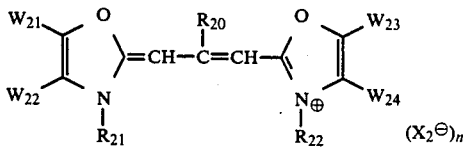

(II)

wherein $W_{21}$, $W_{22}$, $W_{23}$ and $W_{24}$ each represents a hydrogen atom, an alkyl group, or an aryl group; or said $W_{21}$ and $W_{22}$ or said $W_{23}$ and $W_{24}$ combine with each other to form a substituted or unsubstituted benzene ring or a substituted or unsubstituted naphthalene ring; $R_{21}$ and $R_{22}$ each represents an alkyl group; $R_{20}$ represents a hydrogen atom, an alkyl group or an aryl group; $X_2\ominus$ represents an acid anion; and n represents 0 to 1;

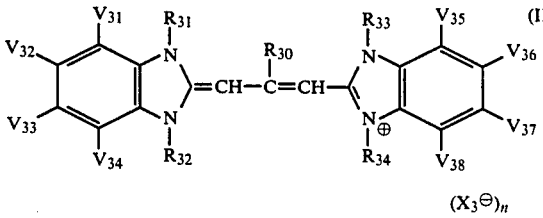

(III)

wherein $V_{31}$ to $V_{38}$ each represents a hydrogen atom, a halogen atom, a trifluoromethyl group, a cyano group, a carboxy group, an alkoxycarbonyl group, a sulfamoyl group, a sulfonyl group, or a carbamoyl group; or said $V_{31}$ and $V_{32}$, said $V_{32}$ and $V_{33}$, said $V_{33}$ and $V_{34}$, said $V_{35}$ and $V_{36}$, said $V_{36}$ and $V_{37}$ or said $V_{37}$ and $V_{38}$ combine with each other to form a carbon ring; $R_{31}$ to $R_{34}$ each represents an alkyl group; $R_{30}$ represents a hydrogen atom, an alkyl group or an aryl group; $X_3\ominus$ represents an acid anion; and n represents 0 to 1;

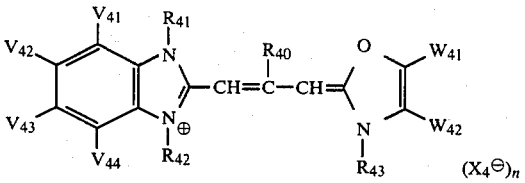

(IV)

wherein $V_{41}$ to $V_{44}$, $R_{41}$ and $R_{42}$ have the same meanings as $V_{31}$ to $V_{34}$, $R_{31}$ and $R_{32}$, respectively, defined for formula (III); $W_{41}$, $W_{42}$, and $R_{43}$ have the same meanings as $W_{21}$, $W_{22}$ and $R_{21}$, respectively, in formula (II); $R_{40}$ represents a hydrogen atom, an alkyl group, or an aryl group; $X_4^{\ominus}$ represents an acid anion; and n represents 0 or 1;

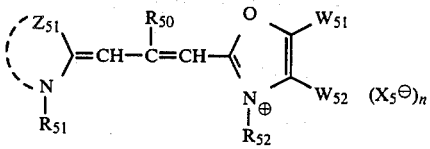

(V)

wherein $Z_{51}$, $R_{50}$, and $R_{51}$ have the same meanings as $Z_{11}$, $R_{10}$, and $R_{11}$, respectively, in formula (I); $W_{51}$, $W_{52}$ and $R_{52}$ have the same meanings as $W_{21}$, $W_{22}$ and $R_{21}$, respectively, in formula (II); $X_5^{\ominus}$ represents an acid anion; and n represents 0 or 1;

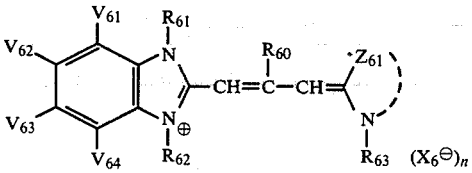

(VI)

wherein $V_{61}$ to $V_{64}$, $R_{61}$ and $R_{62}$ have the same meanings as $V_{31}$ to $V_{34}$, $R_{31}$ and $R_{32}$, respectively, in formula (III); $Z_{61}$, $R_{63}$, and $R_{60}$ have the same meanings as $Z_{11}$, $R_{12}$, and $R_{10}$, respectively, in formula (I); said $Z_{61}$ further includes a non-metallic atomic group completing an indoline nucleus; $X_6^{\ominus}$ represents an acid anion; and n represents 0 to 1;

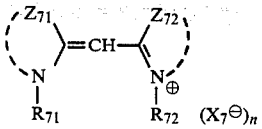

(VII)

wherein $Z_{71}$ and $Z_{72}$ each represents a non-metallic atomic group forming a benzoxazole nucleus, a benzothiazole nucleus, a benzoselenazole nucleus, a naphthoxazole nucleus, a naphthothiazole nucleus, a naphthoselenazole nucleus, thiazole nucleus, a thisazoline nucleus, an oxazole nucleus, a selenazole nucleus, a selenazoline nucleus, a pyridine nucleus, or a quinoline nucleus; $R_{71}$ and $R_{72}$ each represents an alkyl group; $X_7^{\ominus}$ represents an acid anion; and n represents 0 or 1;

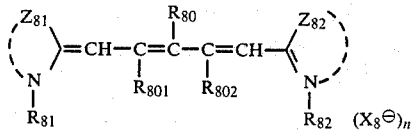

(VIII)

wherein $Z_{81}$ and $Z_{82}$ each represents a non-metallic atomic group completing a pyridine nucleus, a quinoline nucleus, a benzothiazole nucleus, a naphthothiazole nucleus, a benzoxazole nucleus, a benzoselenazole nucleus, a naphthoxazole nucleus, a naphthoselenazole nucleus, a thiazole nucleus, or a thiazoline nucleus; $R_{81}$ and $R_{82}$ each represents a hydrogen atom, an alkyl group, or a halogen atom; or said $T_{801}$ and $R_{802}$ combine with each other to form a ring; $X_8^{\ominus}$ represents an acid anion; and n represents 0 or 1;

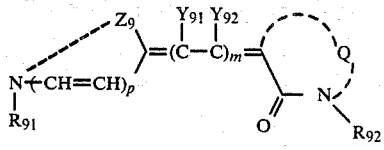

(IX)

wherein $Z_9$ represents a non-metallic atomic group completing a thiazole nucleus, a thizolizolidine nucleus, a selenazolidine nucleus, a selenazolidine nucleus, pyrrolidine nucleus, a dihydropyridine nucleus, an oxazoline nucleus, an oxazolidine nucleus, an imidazoline nucleus, an indoline nucleus, a tetrazoline nucleus, a benzothiazoline nucleus, a benzoselenazoline nucleus, a benzimidazoline nucleus, a benzoxazoline nucleus, a naphthothiazoline nucleus, a naphthoselenazoline nucleus, a naphthoxazoline nucleus, a naphthoimidazoline nucleus, or a dihydroquinoline nucleus; Q represents a non-metallic atomic group necessary for completing a rhodanine nucleus, 2-thiooxazoline-2,4-dione nucleus, 2-thioselenazoline-2,4-dione nucleus, a 2-thiohydantoin nucleus, a barbituric acid nucleus or 2-thiobarbituric acid nucleus, $R_{91}$ and $R_{92}$ each represents a hydrogen atom, an alkyl group, or an aryl group; $Y_{91}$ and $Y_{92}$ each represents a hydrogen atom, an alkyl group or an aryl group; m represents 0, 1 or 2; and p represents 0 or 1.

30. The photographic material as claimed in claim 27, wherein the silver halide in the silver halide emulsion is selected from silver bromide, silver iodide, silver chlorobromide, silver bromoiodide, and the silver chlorobromo-iodide.

31. The photographic material as claimed in claim 27, wherein the silver halide emulsion is composed of at least 50 mol % silver bromide.

32. The photographic material as claimed in claim 31, wherein the silver halide emulsion is a silver bromoiodide emulsion.

33. The photographic material as claimed in claim 32, wherein the silver bromoiodide emulsion contains from zero to less than about 10 mol % silver iodide.

34. The photographic material as claimed in claim 28, wherein the cyanine dye or merocyanine dye which is electron donative and adsorbable on silver halide is selected from a compound represented by any one of formulae (III), (IV), (V), (VI), (VII), (VIII), (IX), (X) and (XI).

35. The photographic material as claimed in claim 27, wherein the cyanine dye or merocyanine dye which is electron donative and adsorbable on silver halide is selected from a compound represented by any of formula (I) and (II)

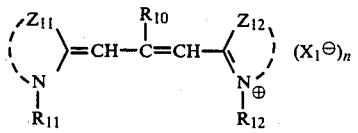

(I)

wherein $Z_{11}$ and $Z_{12}$ each represents a non-metallic atomic group completing a thiazole nucleus, a thiazoline nucleus, benzothiazole nucleus, a naphthothiazole nucleus, benzoselenazole nucleus, or a naphthoselenazole nucleus; $R_{11}$ and $R_{12}$ each represents an alkyl group, $R_{10}$ represents a hydrogen atom, an alkyl group, or an aryl group; $X_1^{\ominus}$ represents an acid anion; and n represents 0 or 1;

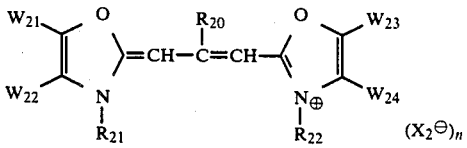

(II)

wherein $W_{21}$, $W_{22}$, $W_{23}$ and $W_{24}$ each represents a hydrogen atom, an alkyl group, or an aryl group; or said $W_{21}$ and $W_{22}$ or said $W_{23}$ and $W_{24}$ combine with each other to form a substituted or unsubstituted benzene ring or a substituted or unsubstituted naphthalene ring; $R_{21}$ and $R_{22}$ each represents an alkyl group; $R_{20}$ represents a hydrogen atom, an alkyl group or an aryl group; $X_2^{\ominus}$ represents an acid anion; and n represents 0 or 1.

* * * * *